US009285149B2

(12) United States Patent
Bamberger et al.

(10) Patent No.: US 9,285,149 B2
(45) Date of Patent: Mar. 15, 2016

(54) INTEGRATED ICE AND BEVERAGE DISPENSER

(71) Applicant: Lancer Corporation, San Antonio, TX (US)

(72) Inventors: Dodge Bamberger, San Antonio, TX (US); Mauro Gonzalez, San Antonio, TX (US); Carlos Perez, San Antonio, TX (US); Merrill Good, San Antonio, TX (US)

(73) Assignee: Lancer Corporation, San Antonio, TX (US)

( * ) Notice: Subject to any disclaimer, the term of this patent is extended or adjusted under 35 U.S.C. 154(b) by 232 days.

(21) Appl. No.: 13/888,086

(22) Filed: May 6, 2013

(65) Prior Publication Data

US 2013/0306680 A1 Nov. 21, 2013

Related U.S. Application Data

(60) Provisional application No. 61/688,238, filed on May 10, 2012.

(51) Int. Cl.
*F25C 5/00* (2006.01)

(52) U.S. Cl.
CPC ..... *F25C 5/002* (2013.01); *F25C 5/007* (2013.01); *F25C 2500/08* (2013.01); *F25C 2600/04* (2013.01)

(58) Field of Classification Search
CPC ..... F25C 5/002; F25C 5/005; F25C 5/007
USPC ..... 222/238
See application file for complete search history.

(56) References Cited

U.S. PATENT DOCUMENTS

| | | | | | |
|---|---|---|---|---|---|
| 3,151,668 | A * | 10/1964 | Zimmermann | G07F 11/68 | 206/283 |
| 3,187,958 | A * | 6/1965 | Swart | B65D 88/66 | 222/227 |
| 3,918,266 | A * | 11/1975 | Gindy | F25C 5/002 | 141/83 |
| 4,641,763 | A * | 2/1987 | Landers et al. | 222/129.1 | |
| 4,846,381 | A * | 7/1989 | Kito et al. | 222/638 | |
| 4,942,983 | A * | 7/1990 | Bradbury | F25C 5/007 | 141/360 |
| 6,561,691 | B1 * | 5/2003 | McCann | F25C 5/007 | 366/299 |
| 2006/0021372 | A1 * | 2/2006 | Wolski et al. | 62/389 | |
| 2006/0169721 | A1 * | 8/2006 | Hammonds et al. | 222/146.6 | |

* cited by examiner

*Primary Examiner* — Daniel R Shearer
(74) *Attorney, Agent, or Firm* — Christopher L. Makay

(57) ABSTRACT

An automated ice dispenser (30) decouples the action of agitating ice stored in an ice bin (69) and the action of dispensing the ice and, additionally, uses a controlled action to dispense the ice. Agitation is achieved with a horizontally mounted agitator (91). Ice is dispensed with a horizontally mounted auger (124). The ice dispenser (30) uses the force created by the auger (124) to push the ice through an opening (71) and out of the bin (69), making the dispensing more consistent and providing the ability to overcome clumping. By making the agitation action independent of the dispensing action, the incidence of clumping is reduced. Agitation is controlled by software, whereunder the agitator (91) turns on based on the cumulative run time of the auger (124). Auger run time and agitation time (as well as other configurable parameters) are adjustable by DIP switches (134) on a control board (133).

11 Claims, 18 Drawing Sheets

INTEGRATED ICE AND BEVERAGE DISPENSER

RELATED APPLICATION

This application claims priority to and all available benefit of U.S. provisional patent application Ser. No. 61/688,238 filed May 10, 2012. By this reference, the full disclosure of U.S. provisional patent application Ser. No. 61/688,238, including the drawings, is incorporated herein as though now set forth in its entirety.

FIELD OF THE INVENTION

The present invention relates to food and beverage handling. More particularly, the invention relates to a novel, preferably integrated, ice and beverage dispenser wherein there is provided decoupled agitation and dispensing of ice.

BACKGROUND OF THE INVENTION

The reliable automated dispensing of extruded ice (also commonly known as pellet, nugget or chewable ice) from a storage bin has long been difficult for manufacturers of ice, and ice and beverage, dispensers. In particular, it has long been known that the extruded ice forms ice blocks inside the storage bin and clumps easily resulting in clogged dispense mechanisms. Notwithstanding this long recognized drawback of the prior art, however, an effective solution to this problem has heretofore eluded the industry.

With this disadvantage of the prior art clearly in mind, therefore, it is an overriding object of the present invention to improve over the prior art by setting forth methods and apparatus for implementing an automated ice dispenser such that dispensing of extruded ice may be reliably had. Additionally, it is an object of the present invention to set forth such methods and apparatus as also provide ancillary advantages and other benefits in the handling of beverage products.

SUMMARY OF THE INVENTION

In accordance with the foregoing objects, the present invention—an integrated ice and beverage dispenser with improved methods and apparatus for handing extruded ice—generally comprises an integrated ice and beverage dispenser (or, in the alternative, simply an automated ice dispenser) having implemented or otherwise provided therein methods and apparatus for decoupling the action of agitating the ice stored in an ice bin and the action of dispensing the ice and for using a controlled action to dispense the ice. The agitation is achieved with an agitator, preferably with the axis mounted horizontally. The ice is dispensed with an auger, also preferably installed horizontally.

In a sharp departure from the prior art, wherein the most common method of dispensing ice is to agitate the ice in a bin and then to rely on gravity to force the ice through an opening and out of the bin, which problematically typically results in extruded ice clumped in pieces that are larger than the opening, the present invention contemplates that the ice dispenser uses the force created by the auger to push the ice through an opening and out of the bin. This makes the dispensing more consistent and provides the ability to overcome any clumping. Also, by making the agitation action independent of the dispensing action, the incidence of clumping is reduced. The agitation is controlled by software or like control means, whereunder the agitator turns on based on the cumulative run time of the auger. Additionally, the auger run time and the agitation time (as well as other configurable parameters) preferably can be adjusted by DIP or like switches on or in communication with a control board or the like provided as part of the host dispenser.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Although those of ordinary skill in the art will readily recognize many alternative embodiments, especially in light of the illustrations provided herein, this detailed description is exemplary of the preferred embodiments of the present invention, the scope of which is limited only by the claims drawn hereto.

Figure 1:
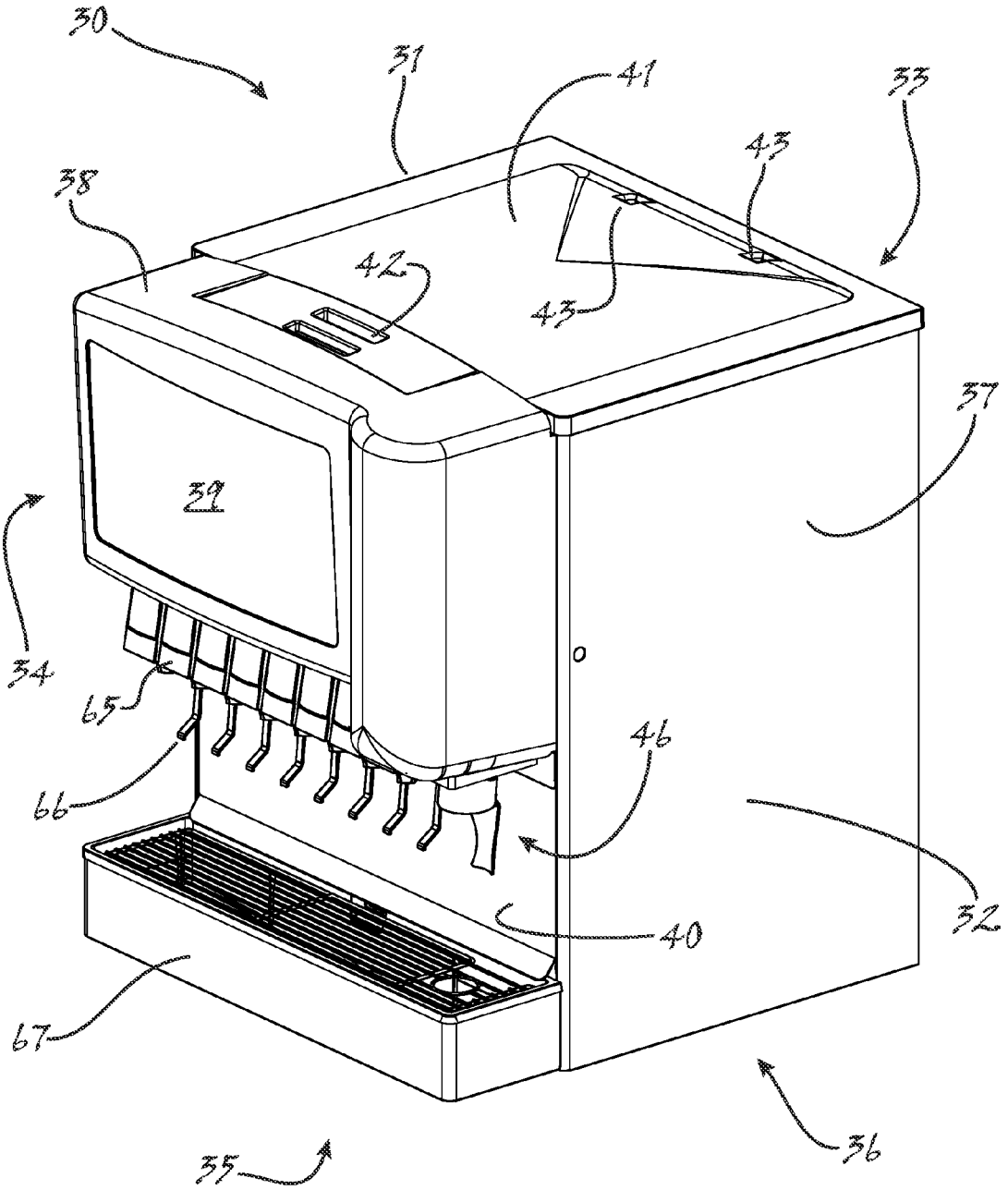
FIG. 1 shows, in a perspective view, an integrated ice and beverage dispenser as adapted for implementation of the present invention and, in particular, shows various external details of the housing for the dispenser as well as the ice chute assembly, plurality of beverage product nozzle assemblies and drip tray of the dispenser.
Figure 2:
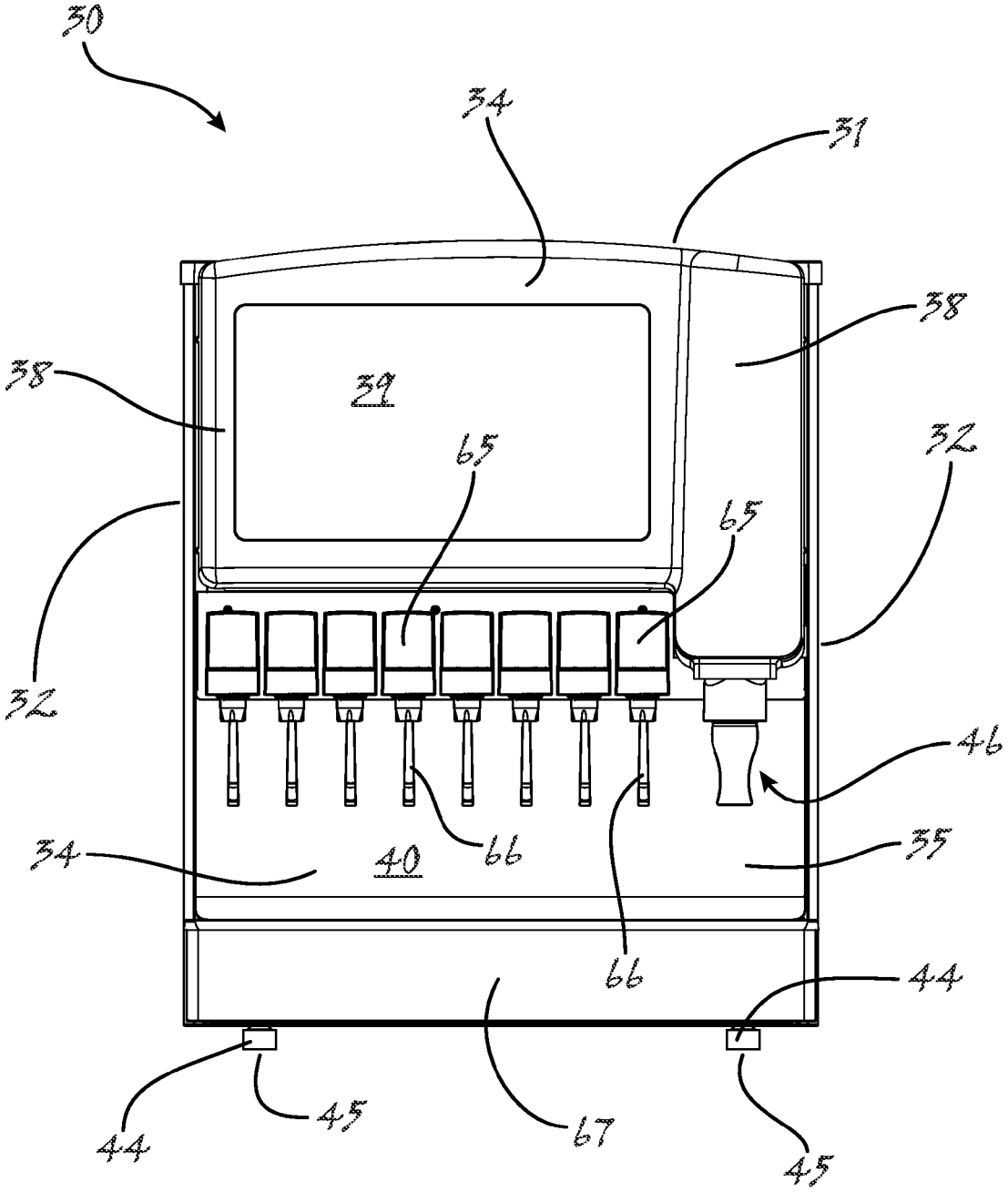
FIG. 2 shows, in a front elevational view, the integrated ice and beverage dispenser of FIG. 1 as presented in FIG. 1.
Figure 3:
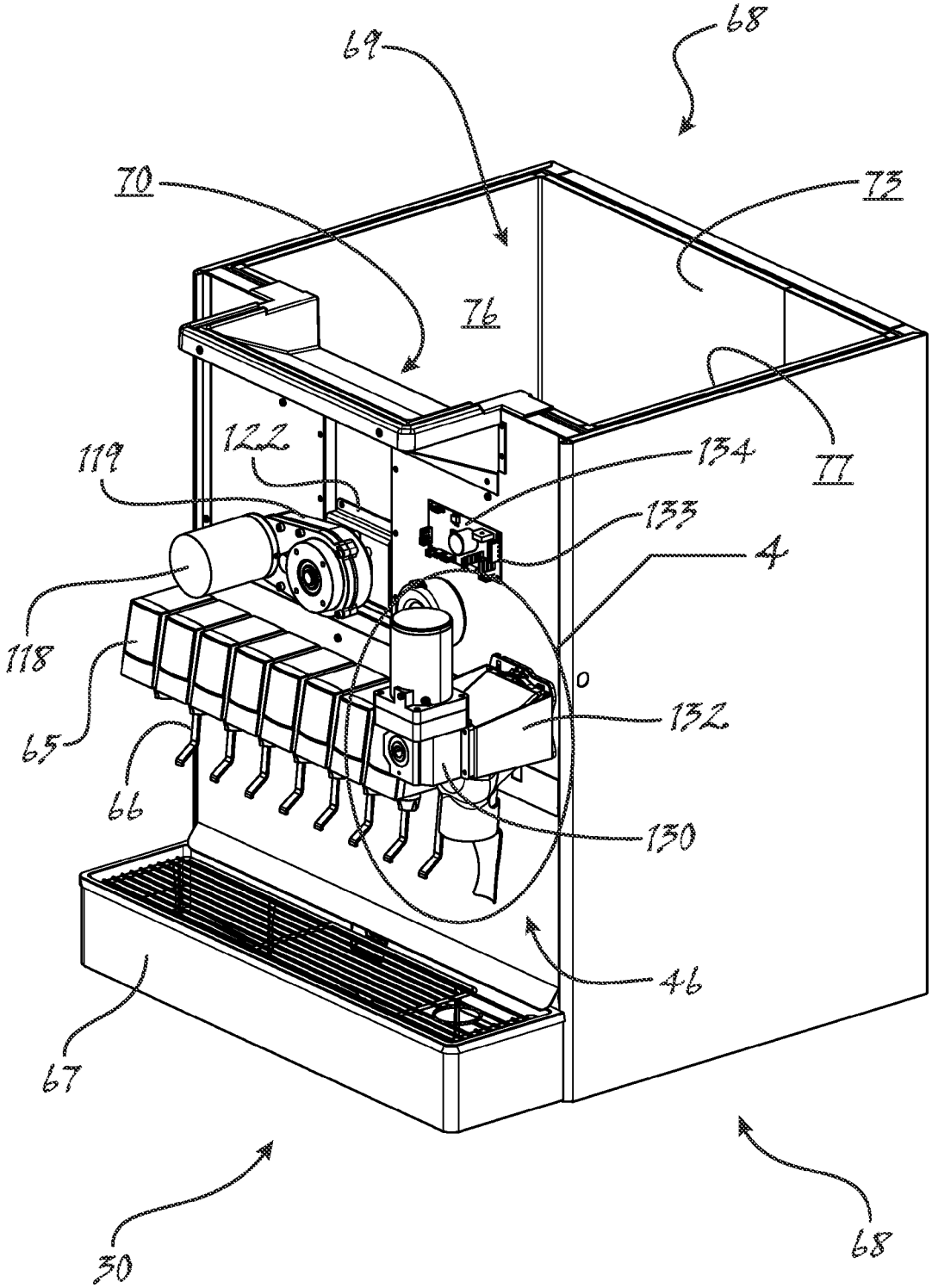
FIG. 3 shows, in a perspective view generally corresponding to that of FIG. 1, the integrated ice and beverage dispenser of FIG. 1 as presented with various elements of the housing removed therefrom.

Referring now to the figures, and to FIGS. 1 through 3 in particular, an integrated ice and beverage dispenser 30 as particularly suitable and adapted for implementation of the methods and apparatus of the present invention is shown to generally comprise a conventional housing 36 disposed about an ice chute assembly 46 and an ice bin 69 and, most preferably, a plurality of beverage product nozzle assemblies 65, which are each conventionally provided with an activator 66 and like components. As will be understood by those of ordinary skill in the art, the various components of the integrated ice and beverage dispenser 30 are arranged on and about a conventional interior frame assembly, such as is well known to those of skill in the art, and which is typically supported atop a plurality of preferably self leveling feet 44, each of which feet 44 may additionally include such conventional features as nonskid bottoms 45 or the like.

As is conventional in the art, the housing 36 preferably comprises a wrapper 37 sized, shaped and otherwise adapted to extend about the sides 32 and back, or rear portion, 37 of the dispenser 30 and which may, if desired in a particular implementation of the present invention, also be adapted to provide primary or supplemental thermal insulation for the ice bin 69 located within the interior 68 space of the dispenser 30. Likewise, the housing 36 also preferably comprises a front cover 38 over and about the upper front 34 of the dispenser 30, which front cover 38 may be conventionally provided with a merchandizing panel 39. As will be better understood further herein, the front cover 38 as most preferably implemented in connection with the present invention is also sized, shaped and otherwise adapted to protectively enclose various components of the ice chute assembly 46 as well as all or various components of an agitator assembly 91, an auger assembly 123 and an ice dispensing circuit 133, each of which will be described in greater detail further herein. In any case, as will be appreciated by those of ordinary skill in the art, the housing 36 may also include a conventional splash plate 40 disposed about the front portion of the base 35 of the dispenser 30 as well as a conventional drip tray 67. Finally, the housing 36 also preferably comprises a lid 41 at the upper end 31 of the dispenser 31 for access to the ice bin 69, which lid 41 may be conventionally attached to the wrapper 37 of the housing 36 or other suitable portion of the dispenser 30 with hinges 43 or like attachments (or, alternatively, may simply rest atop the dispenser 30) and may conveniently be provided with one or more handles 42 for facilitating opening and/or removal.

Figure 5:
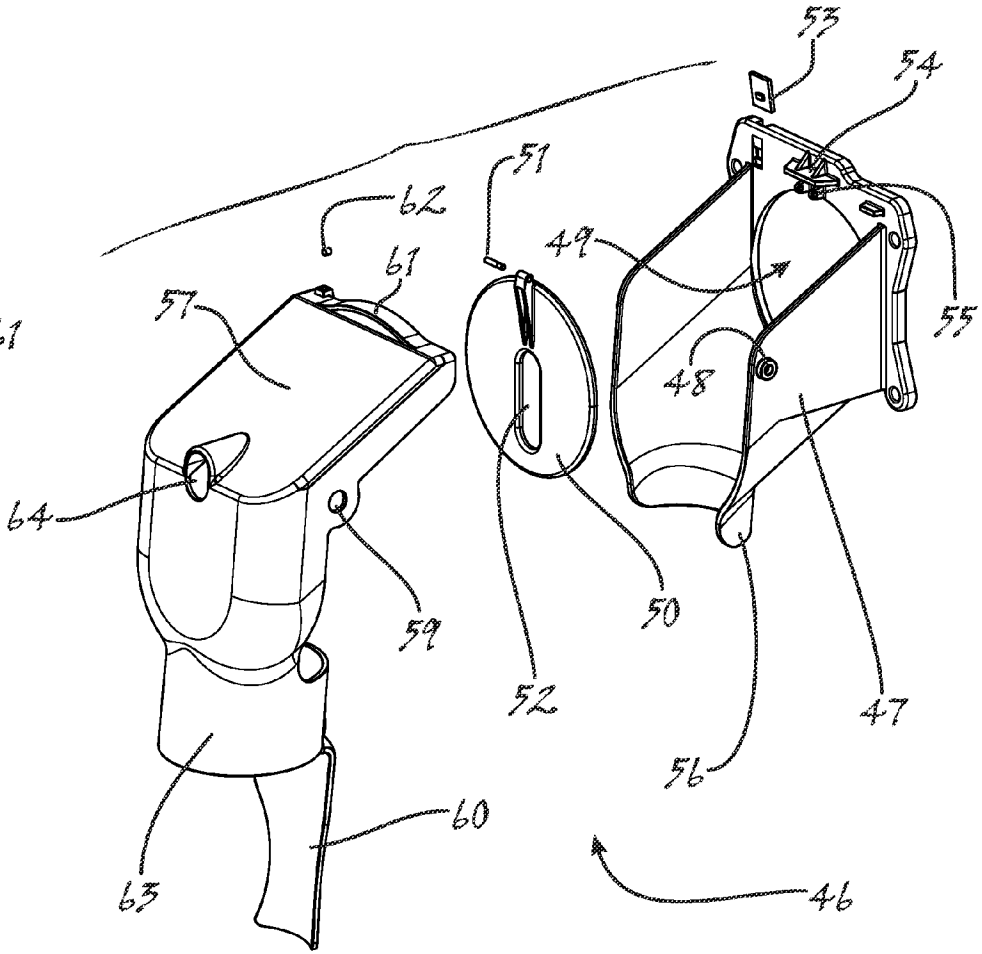
FIG. 5 shows, in a partially exploded view generally corresponding to the views of FIGS. 3 and 4, various additional details of the ice chute assembly of the integrated ice and beverage dispenser of FIG. 1.
Figure 4:
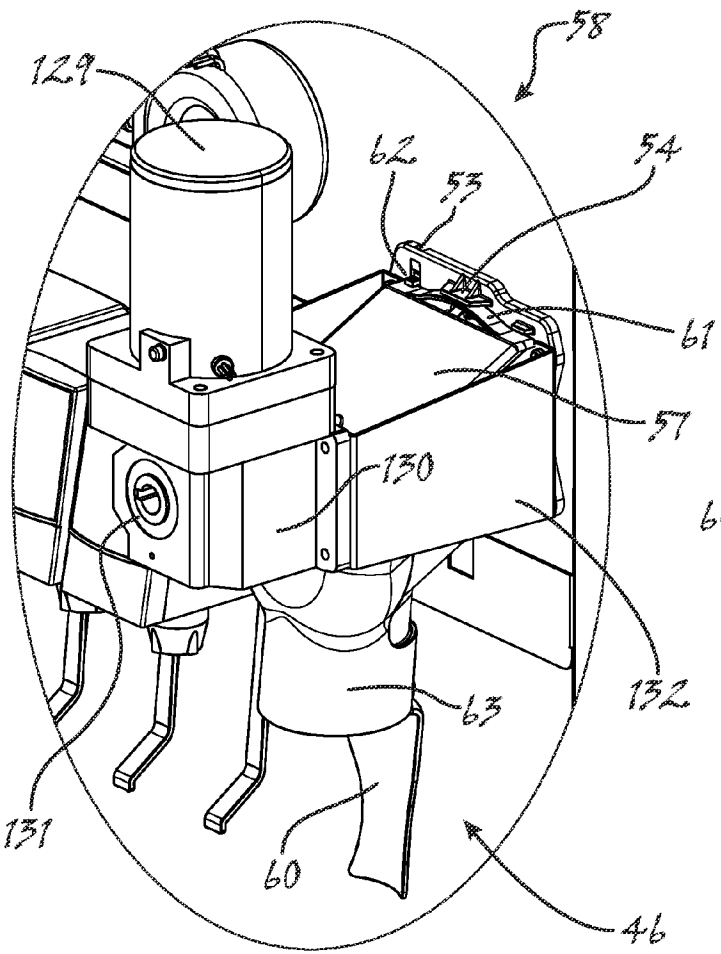
FIG. 4 shows, in a detail view identified in FIG. 3, various details of the ice chute assembly and the auger assembly of the integrated ice and beverage dispenser of FIG. 1.
Figure 6:
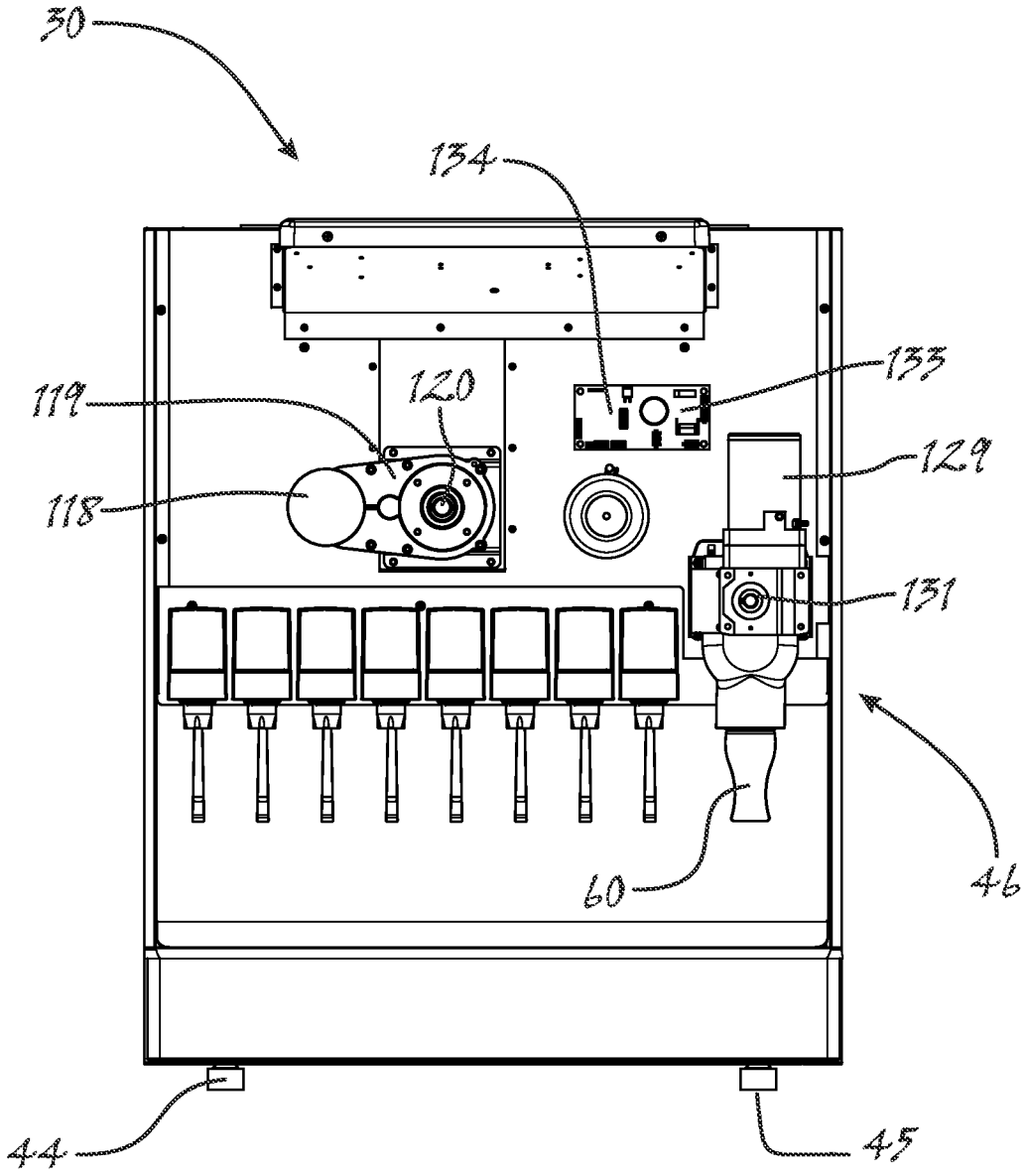
FIG. 6 shows, in a front elevational view generally corresponding to the view of FIG. 2 as presented with various elements of the housing removed therefrom, various details of the interior of the integrated ice and beverage dispenser of FIG. 1 and, in particular, shows various details of the agitator assembly and the auger assembly of the integrated ice and beverage dispenser of FIG. 1.

Referring now to FIGS. 4 through 6, in particular, the ice chute assembly 46 as most preferably implemented for use in connection with the present invention, generally comprises a discharge chute 47 having dependently affixed thereto a cover 57. The discharge chute 47 dependently mounts to the front 34 of the dispenser 30 over and about an ice passage 71, which passage 71 extends from within the ice bin 69, through the front wall 70 of the ice bin 69 at the front 34 of the dispenser 30, to without the dispenser 30. As shown in the figures, the discharge chute 47 also itself comprises an ice passage 49, which passage 49 generally corresponds in size and shape to the ice passage 71 through the front wall 70 of the ice bin 69 at the front 34 of the dispenser 30. In order to maintain the thermal integrity of the ice bin 69, however, a gate 50, as particularly shown in FIG. 5, is provided and adapted to substantially close the ice passage 49 of the discharge chute 48 during periods between active dispensing of ice from the ice bin 69. As shown in FIG. 5, a mounting pin 51 is utilized to hingedly affix the provided gate 50 to gate mounting arms 55 provided on the discharge chute 47 adjacent to and above the ice passage 49 thereof. As will be appreciated by those of ordinary skill in the art, the force of ice being ejected from the ice bin 69 through the provided ice passages 71, 49 will simply cause the gate 50 to swing out and up, thereby allowing the ejected ice to pass freely. Upon clearing of the ice, as the ice flows under the force of gravity down and over the outlet lip 56 of the discharge chute 47, the force of gravity will also cause the gate 50 to simply swing back into closed position over the ice passage 49 of the discharge chute 47. In the alternative, however, those of ordinary skill in the art will in light of this exemplary description recognize that a solenoid or like device may be coupled to the gate 50 for forcibly opening the gate 50 before activation of the auger assembly 123, as otherwise described herein with respect to the begin dispensing function 152 of FIG. 14, and/or forcibly closing the gate 50 following deactivation of the auger assembly 123, as otherwise described herein with respect to the end dispensing function 185 of FIG. 19. As also will, in light of this exemplary description, be appreciated by those of ordinary skill in the art, in any implementation of such a solenoid or the like, the exemplary begin dispensing function 152 of FIG. 14 and/or the exemplary end dispensing function 185 of FIG. 19 may readily be altered to include steps for sending appropriate control signals to such a solenoid or like device.

As also particularly shown in FIG. 5, the cover 57 over the discharge chute 47 is provided with a pair of cover mounting holes 59 which are sized, shaped and otherwise adapted to fit over and about a corresponding pair of cover mounting bosses 48 provided on the upper, outer sides of the discharge chute 47. As will be appreciated by those of ordinary skill in the art in light of this exemplary description, the provided cover mounting holes 59 and corresponding cover mounting bosses 48 thus cooperate to hingedly attach the cover 57 to the discharge chute 47. Additionally, as shown in FIGS. 4 and 5, an electric switch 53, which, as will be better understood further herein, is provided to signal to the ice dispensing circuit 133 that a user desires to obtain ice, is mounted to the discharge chute 47. As also shown in the figures, a switch coupling 62 is provided mounted to the cover 57. Finally, in order to bias the hingedly attached cover 57 in a position flat atop the upper edges of the discharge chute 47, a spring 61 formed in the cover 57 is positioned under and adjacent to a spring stop 54 provided on the discharge chute 47. As will be appreciated by those of ordinary skill in the art in light of this exemplary description, the foregoing described arrangement results in an integral activator 58 formed as part of the ice chute assembly 46 such that when a user presses a cup, or otherwise applies force front to back, against a downwardly projecting lever arm 60 of the cover 57 (which lever arm 60 is conveniently dependently mounted to a directional outlet 63 provided as part of the cover 57) the cover 57 pivots slightly about the cover mounting bosses 48 of the discharge chute 47 causing the spring 61 to compress against the spring stop 54 to allow raising by the switch coupling 62 of the switch 53, thereby activating the switch 53. Likewise, those of ordinary skill in the art will recognize that upon removal of force against the lever arm 60 the spring 61 will act against the spring stop 54 to return the cover 57 to its resting position, which in turn will cause deactivation of the switch 53.

Referring then to FIGS. 4 through 8, in particular, the auger assembly 123 as most preferably implemented in accordance with the present invention is shown to generally comprise an auger, or screw, conveyor 124 and an electric motor 129. As shown in the figures, the auger conveyor 124 conventionally comprises a generally helical blade 125 coiled about an elongate drive shaft 126, the first, drive end 127 of which terminates in a drive bushing 131 of a gearbox 130 operably engaged with the electric motor 129. The second, distal end 128 of the drive shaft 126, on the other hand, is dependently rotationally supported by an auger bushing 75 (or journal bearing), which is preferably provided in the rear wall 73 of the ice bin 69. As particularly shown in FIG. 8, the auger conveyor 124 as dependently supported between the drive bushing 131 and the auger bushing 75 is horizontally installed within the ice bin 69 of the integrated ice and beverage dispenser 30. Additionally, as particularly shown in FIG. 7, the horizontally installed auger conveyor 124 is also preferably installed along and adjacent to the second side wall 77 of the ice bin 69, as shown in the exemplary embodiment, or, in the alternative (not shown), along and adjacent to the first sidewall 76 of the ice bin 69. In any case, as clearly shown in FIGS. 7 and 8, this orientation and location of the auger conveyor 124 enables the forced ejection of ice from any location adjacent to the chosen sidewall front to back within the ice bin 69. In a departure from the known prior art, the provision of an auger assembly 123 for the forced ejection of ice from the ice bin 69 has been found by Applicant to greatly alleviate many of the shortcomings of the prior art as relate to the tendency of extruded ice, in particular, to clump or otherwise form ice blocks in the dispense mechanism.

Figure 8:
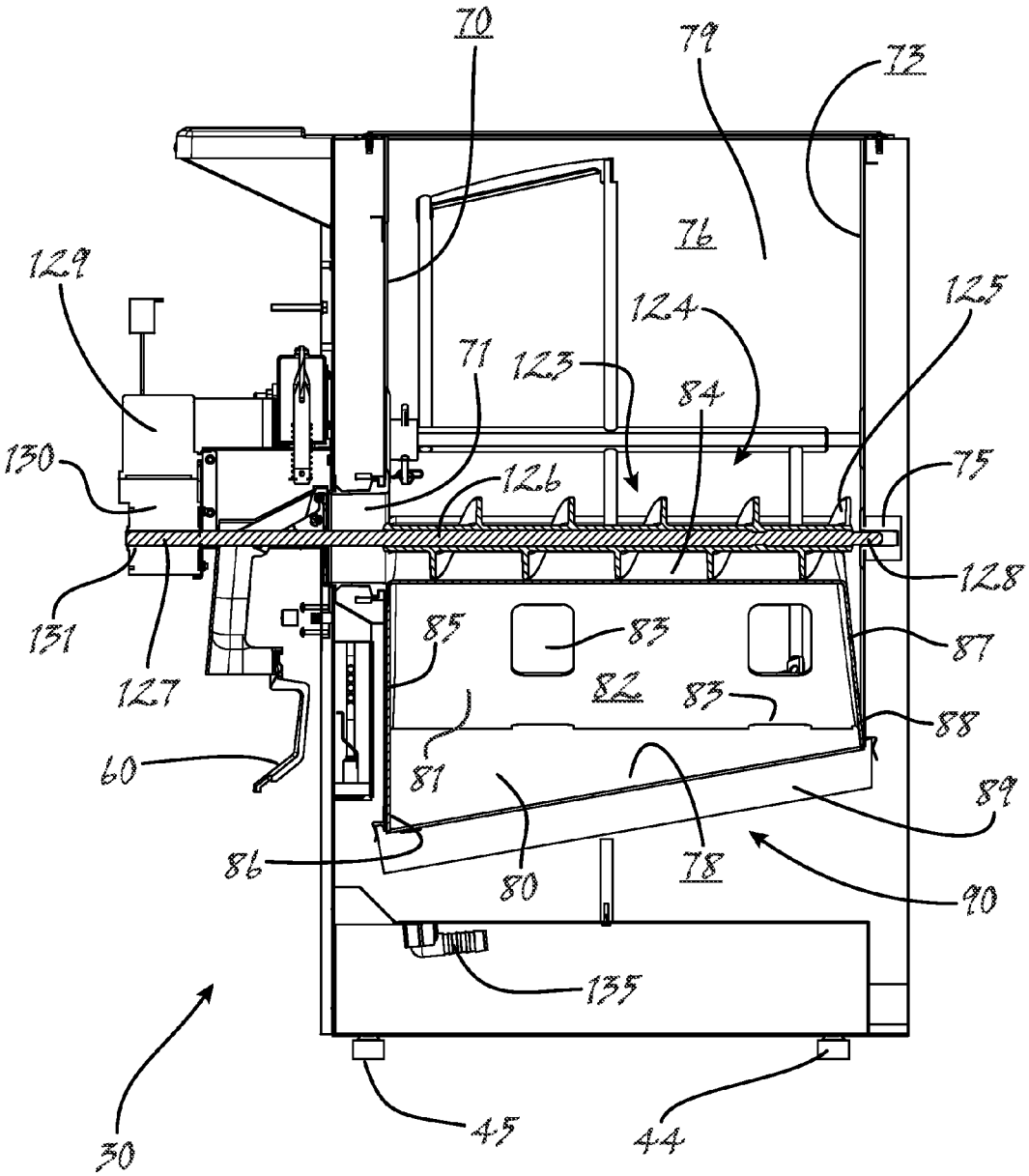
FIG. 8 shows, in a cross-sectional side elevation view taken through cut line 8-8 of FIG. 7, various additional details of the auger assembly, ice chute assembly, cold plate, ice bin and ice bin insert of the integrated ice and beverage dispenser of FIG. 1.

As most clearly depicted in FIG. 8, it is noted that in the described exemplary description, the first, drive end 127 of the drive shaft 126 passes through the ice chute assembly 46 to the gearbox 130, which, along with the electric motor 129, is mounted to the outside of the ice chute assembly 47 through a provided auger motor mount 132, as most clearly depicted in FIG. 4. In order to accommodate this novel arrangement, however, an elongate ovoid auger drive aperture 52, through which the first, drive end 127 of the drive shaft 126 passes, is provided through the gate 50 over the ice passage 49 of the discharge chute 47. In this manner, as will be appreciated by those of ordinary skill in the art, the gate 50 may freely swing up and down, its operation being wholly unimpeded by the passage therethrough of the first, drive end 127 of the drive shaft 126. Likewise, a slightly ovoid auger drive aperture 64, through which the first, drive end 127 of the drive shaft 126 also passes, is provided through the cover 57 over the discharge chute 47. As also will be appreciated by those of ordinary skill in the art, the provision of the slightly ovoid auger drive aperture 64 through the cover 57 enables the cover 57 over the discharge chute 47 to rock freely within its previously described range of motion, its operation being wholly unimpeded by the passage therethrough of the first, drive end 127 of the drive shaft 126.

Turning now, then, to FIGS. 3, 6, 7 and 9, in particular, the agitator assembly 91 as most preferably implemented in the accordance with the present invention is shown to generally comprise an agitator bar assembly 92 and an electric motor 118. Although any of the various features and components of the present invention may generally be combined to greater or lesser extent than presently described, it is deemed a critical aspect of the present invention that the agitator assembly 91 may be operated separately and independently from the operation of the auger assembly 123 such that ice within the ice bin 69 may generally be agitated, jostled or the like at any desired time for agitation and regardless of whether at such a desired time for agitation ice is being dispensed from within the ice bin 69 and, likewise, ice may be dispensed from within the ice bin 69 at any desired time for dispensation and regardless of whether at such time for dispensation ice is being agitated within the ice bin 69. To that end, as used herein, the term "decoupled" as applied to the agitation and dispensing operations under the present invention, or to the implementation under the present invention of the agitator assembly 91 and the auger assembly 123, shall be defined as referring to the described independence of operation. The term "decoupled" should not, however, imply that the two operations could not be simultaneously conducted, but rather that they may be independently conducted.

Figure 7:
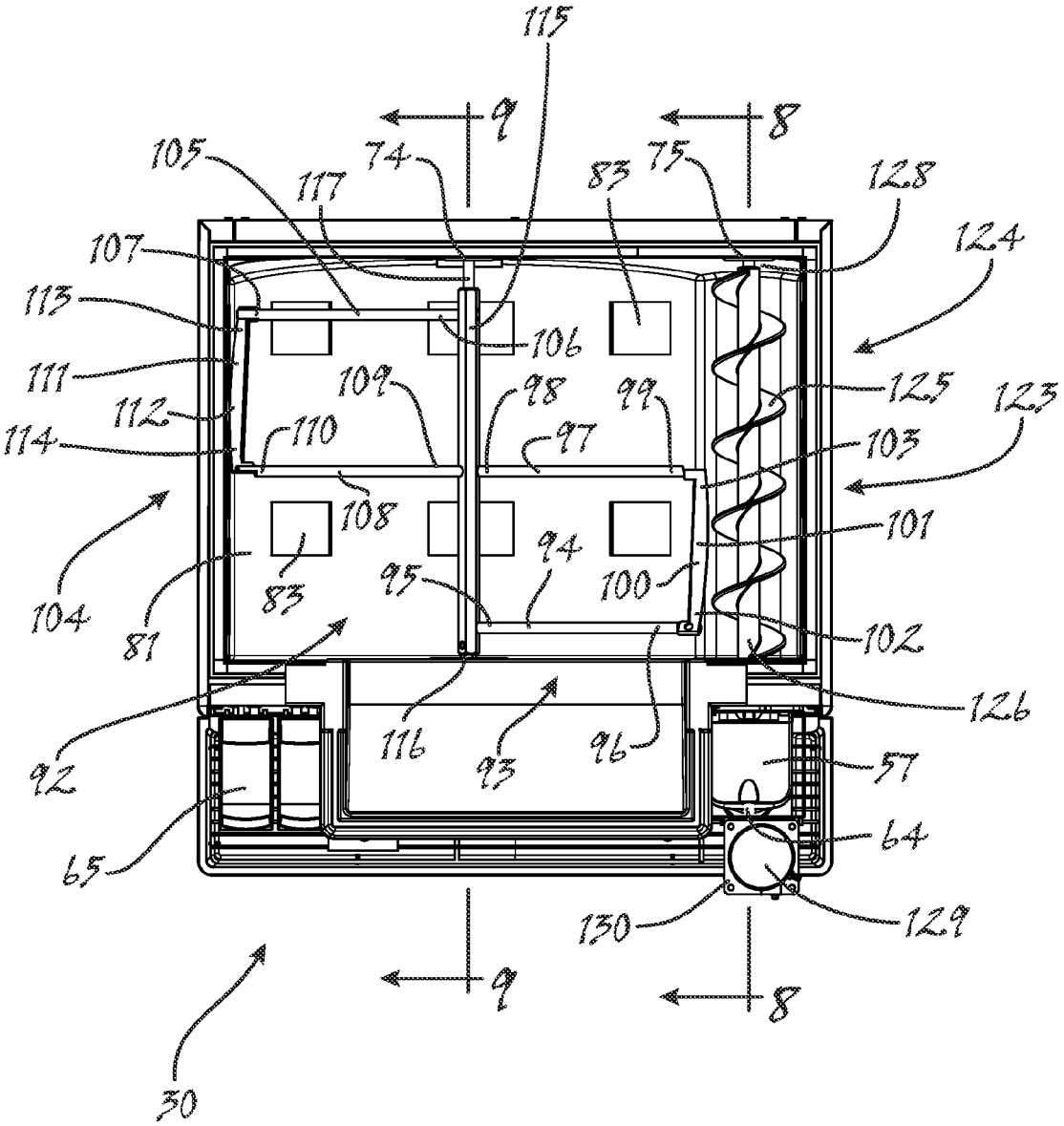
FIG. 7 shows, in a top plan view, various additional details of the integrated ice and beverage dispenser of FIG. 1 as presented in FIG. 6 and, in particular, shows various additional details of the agitator assembly and the auger assembly as located in and contained by the ice bin of the integrated ice and beverage dispenser of FIG. 1.

In any case, as shown in the previously referenced figures, the agitator bar assembly 92 as implemented in connection with the present invention preferably comprises a first, preferably canted paddle assembly 93 dependently radially supported from a drive shaft 115 and an adjacent second, preferably canted paddle assembly 104 also dependently radially supported from the drive shaft 115, the second paddle assembly 104 most preferably being provided generally opposite the first paddle assembly 93 with respect to the drive shaft 115, as most clearly depicted in FIG. 7. As will be better appreciated further herein, the paddle assemblies 93, 104 are during operation of the agitator assembly 91 rotated through the ice supply within the ice bin 69 by the drive shaft 115. To this end, a first, drive end 116 of the drive shaft 115 is operably interfaced with the provided electric motor 118 while a second, distal end 117 of the drive shaft is, on the other hand, dependently rotationally supported by an agitator bushing 74 (or journal bearing), which is preferably provided in the rear wall 73 of the ice bin 69, as particularly shown in FIGS. 7 and 9.

Figure 9:
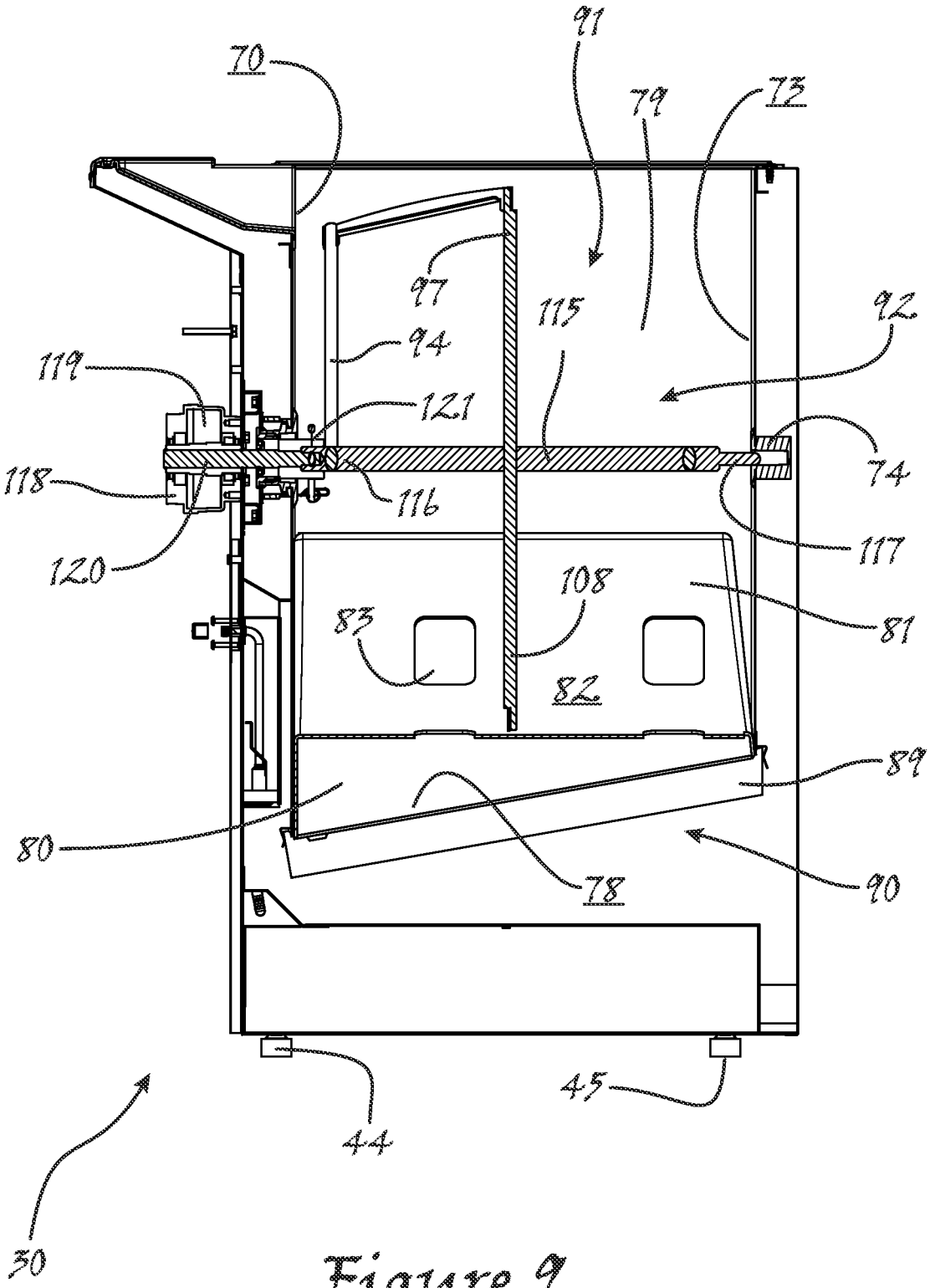
FIG. 9 shows, in a cross-sectional side elevation view taken through cut line 9-9 of FIG. 7, various additional details of the agitator assembly, cold plate, ice bin and ice bin insert of the integrated ice and beverage dispenser of FIG. 1.

As shown in the figures, and most particularly as is shown in FIG. 9, the electric motor 118 of the agitator assembly 91 is most preferably operably interfaced to the drive shaft 115 of the agitator bar assembly 92 through a gearbox 119 or, alternatively, a belt or chain drive, such that the electric motor 118 may operate at a conventional rotational speed while the drive shaft 115 and attached paddle assemblies 93, 104 are more moderately and gently, albeit forcefully, rotated through the ice contained within the ice bin 69. Additionally, in order to facilitate removal from the ice bin 69 of the agitator bar assembly 92 for cleaning and/or removal and replacement of the ice bin insert 81 (described further herein), the drive shaft 115 of the agitator bar assembly 92 is also preferably connected through a provided drive coupling 121 to a separate drive shaft 120 extending from the gearbox 119. Finally, as particularly shown in FIGS. 3 and 6, the electric motor 118 and gearbox 119 are dependently supported from the front 34 of the dispenser 30 by a provided agitator motor mount 122.

Regardless of the particular interface implemented, however, and as particularly shown in FIGS. 8 and 9, the drive shaft 115 of the agitator bar assembly 92 as dependently supported between the drive coupling 121 (or other implemented interface to the electric motor 118) and the agitator bushing 74 is horizontally installed within the ice bin 69 of the ice and beverage dispenser 30. Additionally, as particularly shown in FIG. 7, the horizontally installed drive shaft 115 of the agitator bar assembly 92 is also preferably installed at a generally central location within the ice bin 69 and in an orientation most preferably substantially parallel to the axis of rotation of the auger conveyor 124. In any case, as clearly shown in FIGS. 7 through 9, this orientation and location of the drive shaft 115 of the agitator bar assembly 92, and consequently of the greater agitator assembly 91, results in the agitator assembly 91 being cooperatively adapted with the auger assembly 123 to feed ice within the ice bin 69 to the auger conveyor 124 of the auger assembly 123.

With this in mind, and as particularly shown in FIGS. 7 and 9, the first, preferably canted paddle assembly 93 and the second, preferably canted paddle assembly 104 are described in detail. In describing the assemblies 93, 104, however, it is noted that it is assumed that the electric motor 118 and gearbox 119 are configured such that the agitator bar assembly will rotate in counterclockwise direction as viewed from the front 34 of the dispenser 30 to the back 33 of the dispenser 30. That said, the first paddle assembly 93 comprises a first, "leading" radial arm 94 connected at a first end 95 thereof to the drive shaft 115 of the agitator bar assembly 93 and a second, "trailing" radial arm 97 connected at a first end 98 thereof to the drive shaft 115 of the agitator bar assembly 93. A paddle 100, which, in order to prevent excessive compaction of the extruded ice contained within the ice bin 69, preferably comprises a narrow blade-like structure 101, is connected at a first end 102 thereof to the second end 96 of the first, leading radial arm 94 of the first paddle assembly 93. Likewise, the paddle 100 is connected at a second end 103 thereof to the second end 99 of the second, trailing radial arm 97 of the first paddle assembly 93. As shown in the figures, and assuming that as shown the first paddle assembly 93 is positioned on the drive shaft 115 toward the front portion of the ice bin 69, the first, leading radial arm 94 is most preferably positioned toward the "outside" of the first paddle assembly 93 adjacent to the front wall 70 of the ice bin 69 such that, as the agitator bar assembly 92 rotates through the ice, the ice encountered by the paddle 100 of the first paddle assembly 93 will tend to be jostled both toward the center of the ice bin 69 and toward the center of the auger conveyor 124.

Similarly, the second paddle assembly 104 comprises a first, "leading" radial arm 105 connected at a first end 106 thereof to the drive shaft 115 of the agitator bar assembly 93 and a second, "trailing" radial arm 108 connected at a first end 109 thereof to the drive shaft 115 of the agitator bar assembly 93. A paddle 111, which like the paddle 100 of the first paddle assembly 93 also preferably comprises a narrow blade-like structure 112, is connected at a first end 113 thereof to the second end 107 of the first, leading radial arm 105 of the second paddle assembly 104. Likewise, the paddle 111 is connected at a second end 114 thereof to the second end 110 of the second, trailing radial arm 108 of the second paddle assembly 104. As shown in the figures, and assuming, consistent with the previous discussion of the first paddle assembly 93, that the second paddle assembly 104 is positioned on the drive shaft 115 toward the rear portion of the ice bin 69, the first, leading radial arm 105 is most preferably positioned toward the "outside" of the second paddle assembly 104 adjacent to the rear wall 73 of the ice bin 69 such that, as the agitator bar assembly 92 rotates through the ice, the ice encountered by the paddle 111 of the second paddle assembly 104 will tend to be jostled both toward the center of the ice bin 69 and toward the center of the auger conveyor 124.

Figure 10:
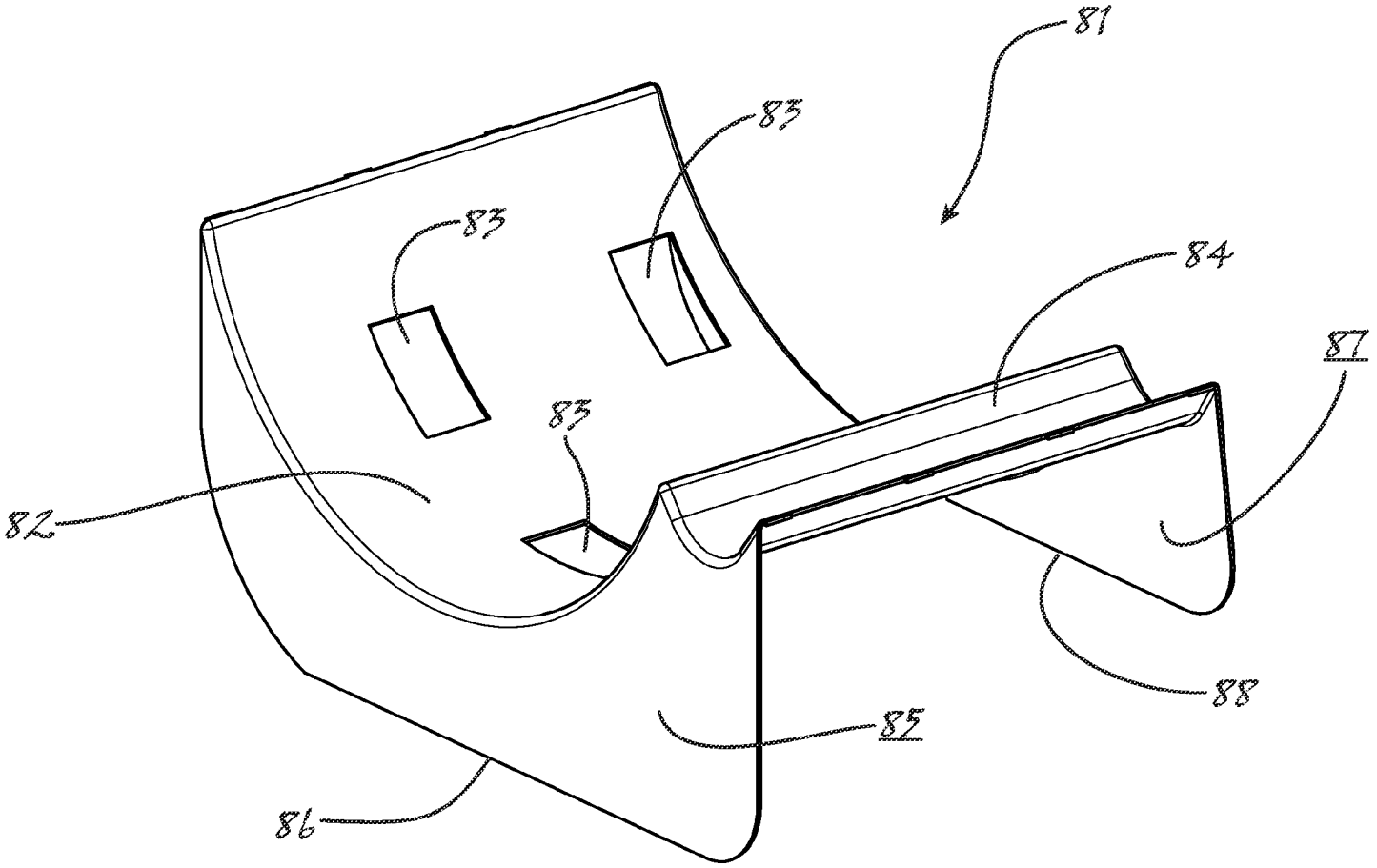
FIG. 10 shows, in a perspective view generally oriented consistent with FIGS. 1 and 3, the ice bin insert of the integrated ice and beverage dispenser of FIG. 1.

Referring then to FIGS. 7 through 10, in particular, it is noted that in order to enable gentle jostling within the ice bin 69 of the extruded ice contained therein, the agitator bar assembly 92 preferably operates adjacent to and just above an agitator trough 82. As particularly shown in FIG. 10, the provided agitator trough 82 most preferably comprises a semicircular cross-section, the radius of which is only slightly greater than the radius of the circular path traversed by the outermost portions of the paddles 100, 111 of the agitator bar assembly 92. Likewise, in order to provide a semi-segregated area for operation of the auger assembly 123, the auger, or screw, conveyor 124 preferably operates adjacent to and just above a separate auger trough 84, which preferably is located a distance above and laterally offset from the lowermost portion of the agitator trough 82. Similar to the configuration of the agitator trough 82, and also as particularly shown in FIG. 10, the provided auger trough 84 most preferably comprises a semicircular cross-section, the radius of which is only slightly greater than the radius of the circular path traversed by the outermost portions of the blade 125 of the auger conveyor 124. Because of the spatial separation afforded by the separately provided troughs 82, 84, the bulk of the ice within the ice bin 69 may periodically be gently jostled separate and apart from the relatively small portion of ice that has found its way into contact with the helical blade 125 of the auger conveyor 123 and which, as a consequence, may have suffered some degree of compaction. Additionally, those of ordinary skill in the art will with the benefit of this exemplary disclosure recognize that, with the arrangement as depicted in FIG. 10, operation of the agitator assembly 91 will tend to scoop ice located in the main portion of the ice bin 69 upward and into the trough 83 underlying the auger assembly 123, thereby shuffling the loosely packed ice from the area adjacent the first side wall 76 of the ice bin 69 and toward the second side wall 77 of the ice bin adjacent to the auger assembly 123.

Although the described troughs 82, 84 could readily be formed as the floor of the ice bin 69, the most preferred implementation of the present invention contemplates that the troughs 82, 84 will be provided in connection with an ice bin insert 81 adapted to rest upon the floor 79 of the ice bin 69, thereby serving to separate the ice bin 69 into an upper compartment 79 and a lower compartment 80. In this manner, the present invention additionally provides means for servicing of a cold plate 89, which, as is well known to those of ordinary skill in the art, comprises a block structure of thermally conductive material through which is provided one or more internal beverage product passages 90 in fluid communication with one or more beverage product nozzle assemblies 65. Specifically, as shown in the various figures and, in particular, in FIG. 10, the ice bin insert 81 is provided with a plurality of apertures 83 through which small quantities of extruded ice may fall from the upper compartment 79 to the lower compartment 80 as ice in the lower compartment 80 melts. As will be better appreciated further herein, the methods of the present invention specifically support this arrangement inasmuch as the agitator assembly 91 may be operated independently of whether ice is dispensed by the auger assembly 123 in order to periodically jostle the ice over and above the apertures 83, thereby ensuring that ice bridges do not form over the apertures 83 and, consequently, that there is always a ready supply of ice in the lower compartment 80.

Finally, as shown in FIG. 9, the floor 78 of the of the ice bin 69 is preferably sloping (as depicted, forward sloping) such that as ice in the lower compartment 80 melts the resulting water may drain through a provided drain connection 135. As a result, as shown in FIG. 10, the front face 85 and the rear face 87 of the ice bin insert 81 are adapted to accommodate the sloping floor 78 such that as the bottom edges 85, 88, respectively, of the faces 85, 87 rest upon the floor 78 the agitator trough 82 and the auger trough 84 remain substantially level and in close conformance about the agitator assembly 92 and the auger conveyor 124, respectively.

Turning now then to the methods of operation of the present invention, there is shown in FIGS. 11 through 22 various flowcharts detailing an exemplary software program flow. It should be noted, however, that none of the flowcharts, nor any terminology, notation, form, symbol, variable name, variable usage or the like used therein or in this description, is meant to limit the methods to any particular programming style, language or the like, such details of implementation being entirely within the realm of design choice and all well within the ordinary skill in the art in light of the following exemplary description of the concepts of operation. Likewise, although the most preferred embodiment of the present invention contemplates implementation through software, the invention is not to be limited to such a software implementation, but rather may comprise software, firmware, hardware or the like, or any combination thereof, in realization of any implemented functionality. As a result, the description following should, unless otherwise expressly indication or otherwise clearly limited, be taken as being exemplary only of the inventive concepts claimed as the present invention.

Figure 11:
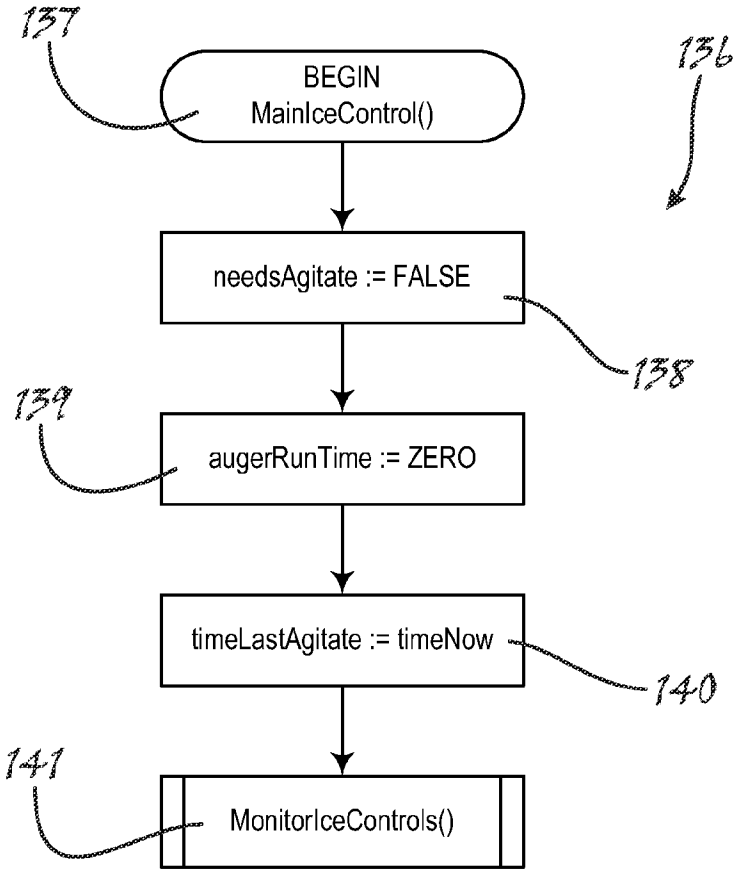
FIG. 11 shows, in a flowchart, top level details of an exemplary main ice control program as may be implemented for operation of the integrated ice and beverage dispenser of FIG. 1 in accordance with the methods of the present invention.

Continuing then with the discussion of the exemplary implementation of the methods of the present invention and the manner of use of the invention, and as shown in FIG. 11, various variables are initialized upon starting (step 137) of the exemplary main ice control program 136, which, as will be appreciated by those of ordinary skill in the art, may occur automatically upon power up by a user of the integrated ice and beverage dispenser 30. In particular, and assuming that the optional agitation monitor routine 143 of FIG. 12 (which will be better understood further herein) is implemented, a needsAgitate variable is set (step 138) to FALSE to indicate that the agitator assembly 91 need not at the present time be activated solely as a matter of the passage of time. Additionally, an augerRunTime variable, which tracks the cumulative time that the auger assembly 123 has operated since the beginning of the most previous activation of the agitator assembly 91 and, consequently, serves as a measure of the depletion of ice in and about the auger trough 82 and auger conveyor 124 due to the dispensing of ice, is initialized (step 139) to ZERO. Finally, a timeLastAgitate variable, which tracks the time at which the most previous activation of the agitator assembly 91 began, is initialized (step 140) to the then present time timeNow. With the main variables so initialized, the main ice control program calls (step 141) the monitor ice controls routine 142, as shown in FIG. 13, under which the routine 142 cycles through a repeat loop 149 to determine (1) whether the lever arm 60 of the integral activator 58 has been deflected by a user, indicating that the user desires that ice be dispensed, or (2) whether agitation of the ice within the ice bin 69 is required as a matter of the passage of time as determined by the agitation monitor routine 143 of FIG. 12.

Figure 12:
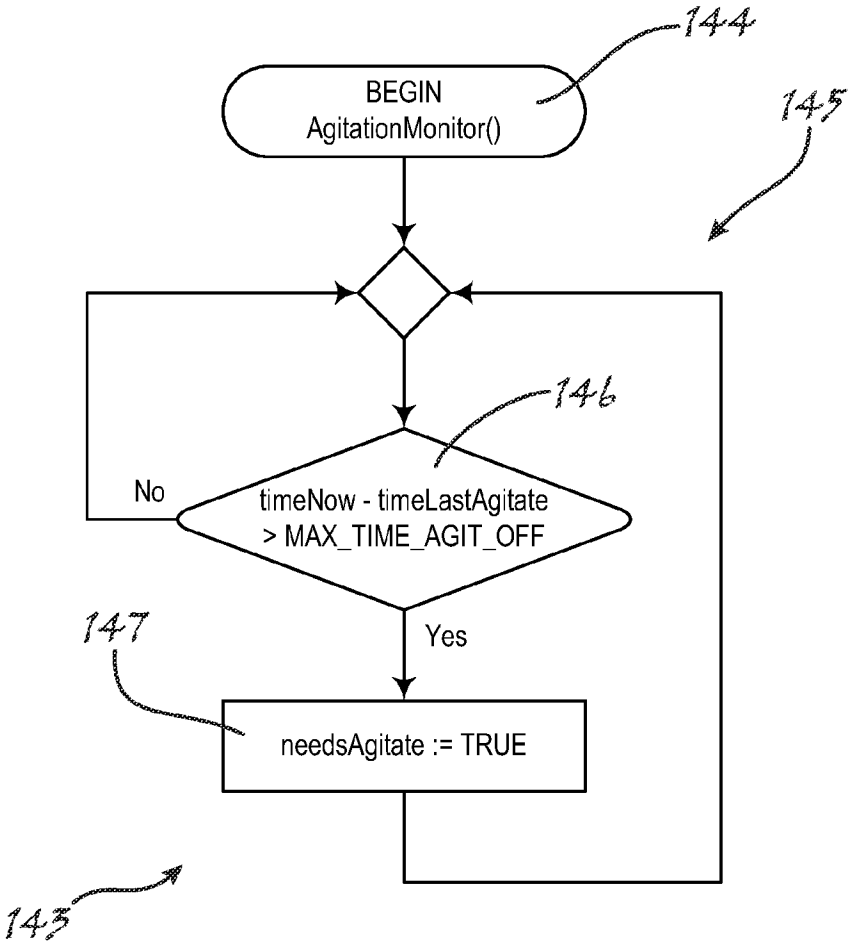
FIG. 12 shows, in a flowchart, top level details of an exemplary agitation monitor routine as may be implemented in connection with the main ice control program of FIG. 11 for operation of the integrated ice and beverage dispenser of FIG. 1 in accordance with further methods of the present invention.

As previously mentioned, the agitation monitor routine 143 of FIG. 12 is a routine that allows for activation and operation of the agitator assembly 91 solely as a matter of the passage of time. While the agitation monitor routine 143 need not be implemented in order to realize at least some aspects of the present invention, it is noted that the routine 143 is particularly useful and desired for ensuring that ice within the ice bin 69 does not freeze into clumps between agitation cycles triggered in response to dispensing operations and/or that ice in the lower compartment 80 of the ice bin 69 is replenished upon melting. In any case, utilization of an implemented agitation monitor routine 143 may controlled by selecting the utilization of the feature with DIP switches 134 or the like provided on the ice dispensing circuit 133. If implemented and operational, the agitation monitor routine 143 will generally start (step 144) concurrently with the main ice control program 136. Under the agitation monitor routine 143, a repeat loop 145 operates to continuously determine whether the elapsed time since the time at which the most previous activation of the agitator assembly 91 began, i.e. timeNow—timeLastAgitate, has exceeded a preferably user configurable constant MAX_TIME_AGIT_OFF indicating the maximum length of time that should ever pass without activation of the agitator assembly (step 146). If the elapsed time since agitator assembly 91 was last activated is ever found by the agitation monitor routine 143 to have exceeded the set maximum allowed time, the variable needsAgitate is set (step 147) to TRUE and the condition is handled by the monitor ice controls routine 142 of FIG. 13 as described further herein.

Figure 13:
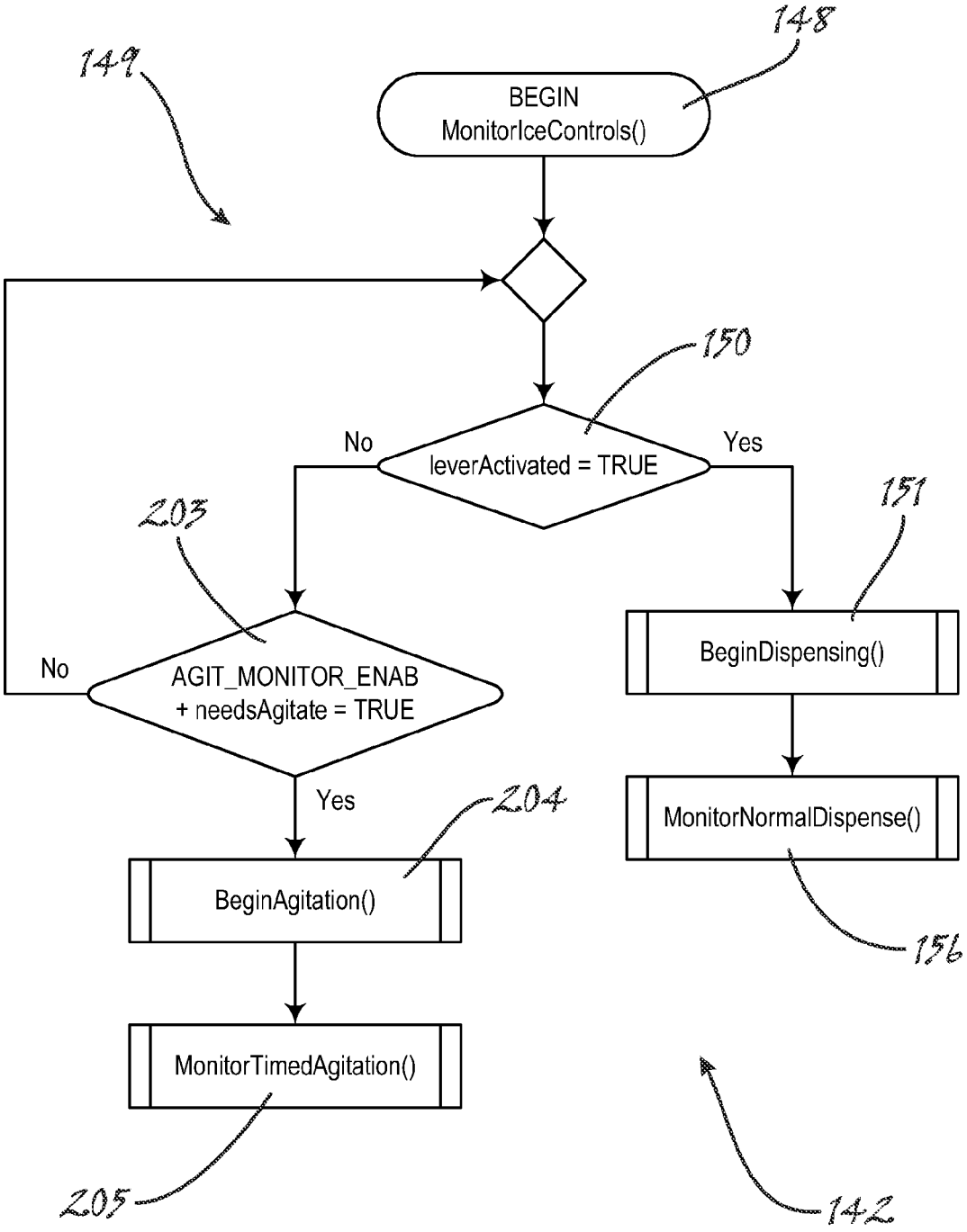
FIG. 13 shows, in a flowchart, an exemplary monitor ice controls routine as may be implemented under the main ice control program of FIG. 11 for operation of the integrated ice and beverage dispenser of FIG. 1.

Turning then to FIG. 13, and as previously mentioned, upon starting (step 148) of the monitor ice controls routine 142 (step 141), a repeat loop 149 operates to determine (1) whether the lever arm 60 of the integral activator 58 has been deflected (step 150), indicating that a user desires that ice be dispensed, or (2) whether agitation of the ice within the ice bin 69 is required (a) as a matter of the passage of time as determined by the agitation monitor routine 143 of FIG. 12 (step 203) and (b), as indicated by a TRUE value of a flag AGIT MONITOR ENAB, the optional monitoring implemented by the agitation monitor routine 143 is active. So long as neither condition of the repeat loop 149 returns TRUE, the repeat loop 149 continues to cycle. If, on the other hand, either condition checks TRUE, the first in condition sequence to so check will trigger additional action. In particular, if it is first determined that the lever arm 60 of the integral activator 58 has been deflected (step 150), the monitor ice controls routine will operate to first call (step 151) the begin dispensing function 152 of FIG. 14, thereby causing, as described further herein, activation of the auger assembly 123. Upon return from the begin dispensing function 152, the monitor ice controls routine 142 will then operate to call (step 156) the monitor normal dispense routine 157 of FIG. 15, under which, as will be better understood further herein, the depletion of ice in and about the auger trough 82 and auger conveyor 124 due to the dispensing of ice is monitored as ice is dispensed from the ice bin 69, thereby ensuring that sufficient ice supply remains available throughout the dispensing operation. If, on the other hand, it is first determined that agitation of the ice within the ice bin 69 is required as a matter of the passage of time (step 203), the monitor ice controls routine 142 will operate to first call (step 204) the begin agitation function 165 of FIG. 16, thereby causing, as described further herein, activation of the agitator assembly 91. Upon return from the begin agitation function 165, the monitor ice controls routine 142 will then operate to call (step 205) the monitor timed agitation routine 206 of FIG. 21, under which, as will be better understood further herein, the routine 206 operates to monitor whether, during passage of the established time for agitation, the lever arm 60 of the integral activator 58 has been deflected (step 209), indicating that a user desires that ice be dispensed and, if so, ensures that the user's desire is immediately acted upon.

Figures 14, 18, 19:
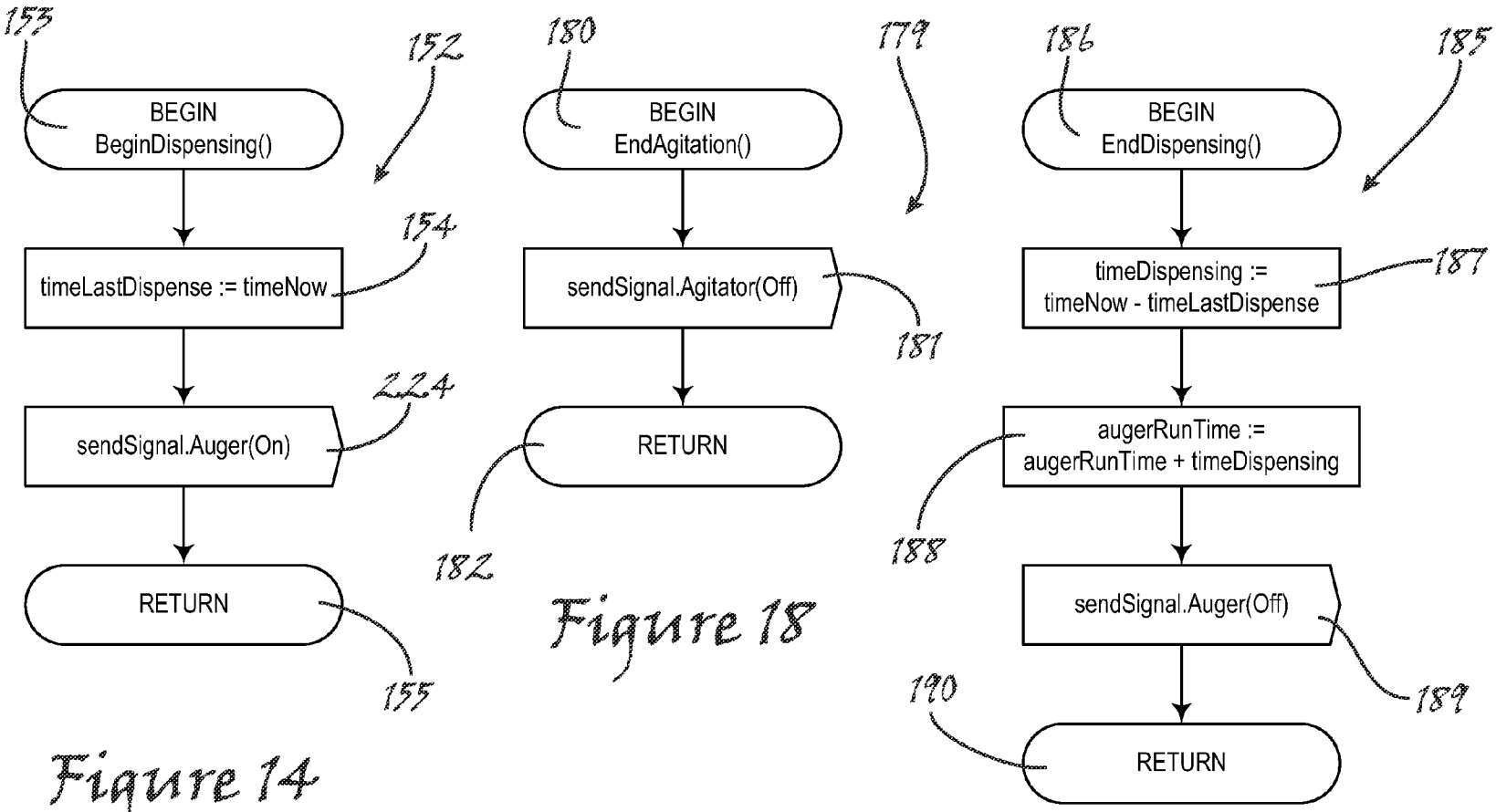
FIG. 14 shows, in a flowchart, an exemplary begin dispensing function as may be implemented in connection with the main ice control program of FIG. 11 for software controlled activation of the auger assembly of the integrated ice and beverage dispenser of FIG. 1.
FIG. 18 shows, in a flowchart, an exemplary end agitation function as may be implemented in connection with the main ice control program of FIG. 11 for software controlled deactivation of the agitator assembly of the integrated ice and beverage dispenser of FIG. 1.
FIG. 19 shows, in a flowchart, an exemplary end dispensing function as may be implemented in connection with the main ice control program of FIG. 11 for software controlled deactivation of the auger assembly of the integrated ice and beverage dispenser of FIG. 1.

As discussed hereinabove, if it is determined under the monitor ice controls routine 142 that the lever arm 60 of the integral activator 58 has been deflected (step 150), the monitor ice controls routine 142 will operate to first call (step 151) the begin dispensing function 152 of FIG. 14. As depicted in FIG. 14, upon starting (step 153) of the begin dispensing function 152, the timeLastDispense variable is set (step 154) to the then present time timeNow and a control signal is sent (step 224) to activate the electric motor 129 of the auger assembly 123, the details of implementation of such control signal being well within the ordinary skill in the art. As previously discussed, the auger assembly 123 will then begin operating to dispense ice from the ice bin 69 through the ice chute assembly 46. In any case, upon sending (step 224) of the control signal to activate the auger assembly, the begin dispensing function 152 will then return (step 155) to the program flow location immediately following that from which the function 152 was called, which in the present case is back to the monitor ice controls routine 142 of FIG. 13 to then call (step 156) the monitor normal dispense routine 157 of FIG. 15.

Figure 15:
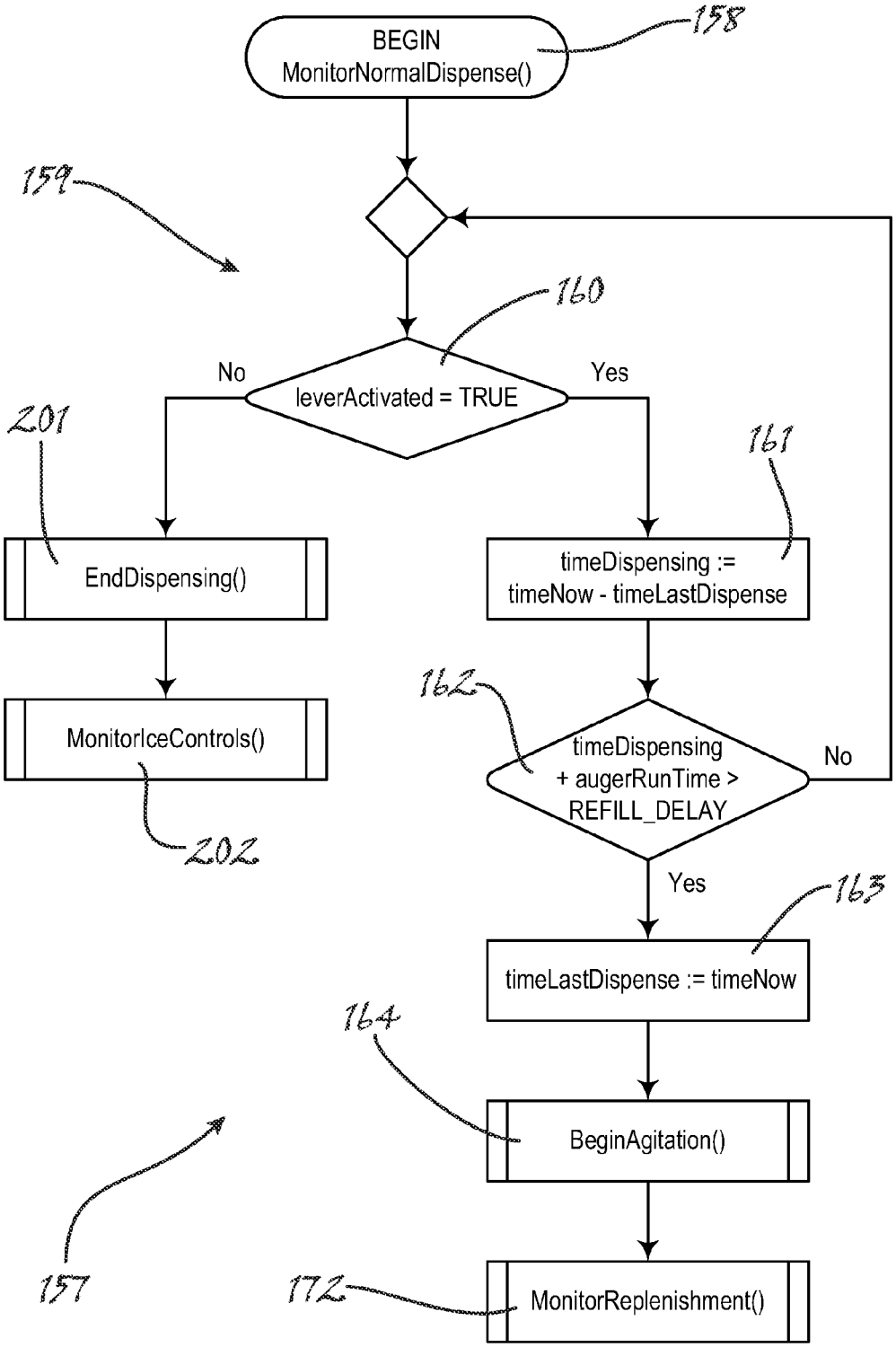
FIG. 15 shows, in a flowchart, an exemplary monitor normal dispense routine as may be implemented under the main ice control program of FIG. 11 for operation of the integrated ice and beverage dispenser of FIG. 1.

Referring then to FIG. 15, upon starting (step 158) of the monitor normal dispense routine 157, a repeat loop 159 is initiated under which (1) the continued deflection or release of the lever arm 60 of the integral activator 58 is monitored and determined and (2) the total time that the auger assembly 123 has operated since the beginning of the most previous activation of the agitator assembly 91 is monitored to ensure that ice in and about the auger trough 82 and auger conveyor 124 remains sufficient to continue the dispensing operation without need for replenishment through activation of the agitator assembly 91. If during the repeat loop 159 it is first determined that the lever arm 60 of the integral activator 58 is no longer deflected (step 160), the monitor normal dispense routine 157 escapes the repeat loop 159 and immediately calls (step 201) the end dispensing function 185 of FIG. 19. Upon starting (step 186) the end dispensing function 185, as shown in FIG. 19, a timeDispensing variable is calculated (step 187) as the length of time elapsed under the present dispensing operation; the calculated dispensing time is added (step 188) to the cumulative augerRunTime variable, which, as previously discussed, tracks the cumulative time that the auger assembly 123 has operated since the beginning of the most previous activation of the agitator assembly 91; and a control signal (the details of implementation of such control signal being well within the ordinary skill in the art) is sent (step 189) to deactivate the electric motor 129 of the auger assembly 123, after which the end dispensing function 185 will then return (step 190) to the program flow location immediately following that from which the function 185 was called, which in the present case is back the monitor normal dispense routine 157 of FIG. 15 to then call (step 202) the monitor ice controls routine 142 of FIG. 13, which routine 142, it is noted, will start anew at its beginning step (step 148).

Figure 16:
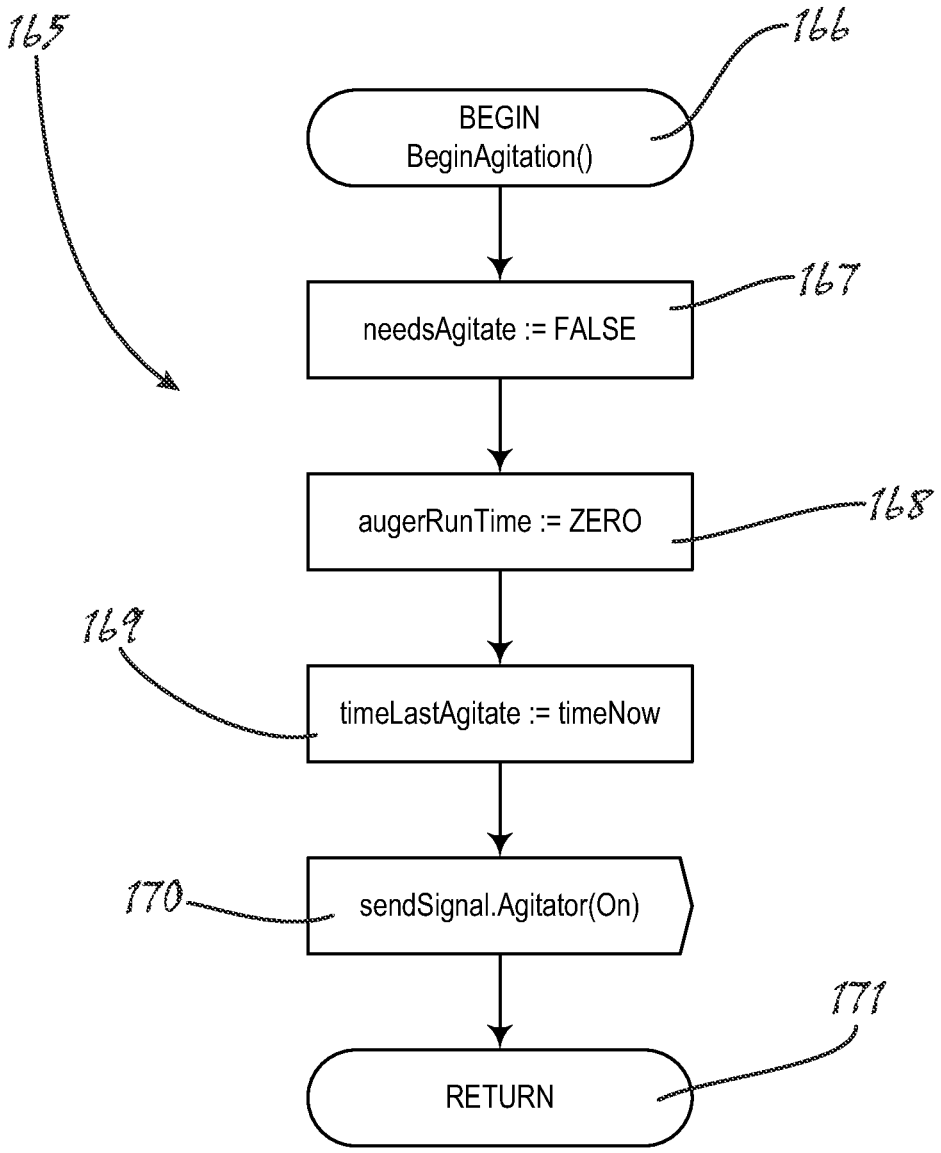
FIG. 16 shows, in a flowchart, an exemplary begin agitation function as may be implemented in connection with the main ice control program of FIG. 11 for software controlled activation of the agitator assembly of the integrated ice and beverage dispenser of FIG. 1.

If, on the other hand, during the repeat loop 159 of the monitor normal dispense routine 147 of FIG. 15 it is not first determined the lever arm 60 of the integral activator 58 is no longer deflected, i.e., has not be released and is still activated, (step 160), the repeat loop 159 continues to determine whether the quantity of ice in and about the auger trough 82 and auger conveyor 124 due to the dispensing of ice has likely been depleted to a level where there is imminent risk that the ice supply will be insufficient to continue the dispensing operation. In particular, the timeDispensing variable is calculated (step 161) as the length of time elapsed under the present dispensing operation and the sum of the calculated dispensing time and the cumulative augerRunTime variable is compared (step 162) to a REFILL_DELAY constant, which is a configured estimated or otherwise predetermined time over which dispensing may safely take place before it may be expected that ice in and about the auger trough 82 and auger conveyor 124 will likely be imminently depleted due to the ongoing dispensing of ice. If the calculated sum does not exceed the REFILL_DELAY constant, the repeat loop 159 continues. If, on the other hand, the calculated sum does exceed the REFILL_DELAY constant, the monitor normal dispense routine 157 escapes the repeat loop 159 and sets (step 163) the timeLastDispense variable to the then present time timeNow and immediately calls (step 164) the begin agitation function 165 of FIG. 16 to activate the agitator assembly 91. As shown in FIG. 16, upon starting (step 166) of the begin agitation function 165, the begin agitation function 165 reinitializes (step 167) the needsAgitate variable to FALSE; reinitializes (step 168) the augerRunTime variable to ZERO; sets (step 169) the timeLastAgitate variable to the then present time; and then sends (step 170) a control signal to activate the electric motor 118 of the agitator assembly 91, the details of implementation of such control signal being well within the ordinary skill in the art. The agitator assembly 91 will then begin operating, as previously discussed, to jostle the ice within the ice bin 69 and, in the course thereof, will replenish the ice in and about the auger trough 82 and auger conveyor 124. In any case, upon sending (step 170) of the control signal to activate the agitator assembly 91, the begin agitation function 165 will then return (step 171) to the program flow location immediately following that from which the function 165 was called, which in the present case is back the monitor normal dispense routine 157 of FIG. 15 to then call (step 172) the monitor replenishment routine 173 of FIG. 17, which serves to ensure that once agitation begins during a normal dispensing operation, ample time elapses to ensure that replenishment of the ice in and about the auger trough 82 and auger conveyor 124 is sufficient to either return to the monitor normal dispense routine 157 of FIG. 15 or (as will be better understood further herein) to the monitor ice controls routine 142 of FIG. 13.

Figure 17:
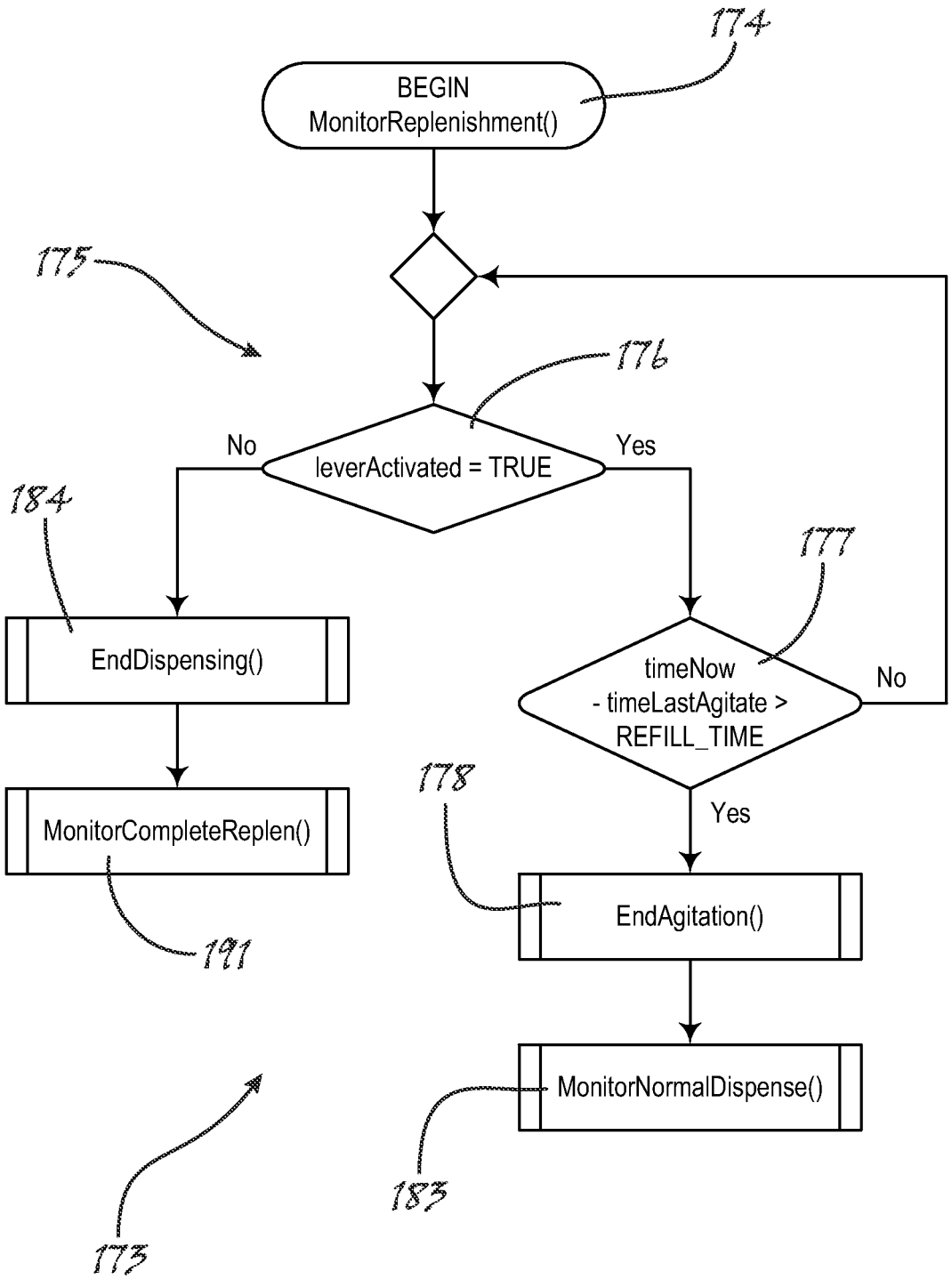
FIG. 17 shows, in a flowchart, an exemplary monitor replenishment routine as may be implemented under the main ice control program of FIG. 11 for operation of the integrated ice and beverage dispenser of FIG. 1.

Turning then to FIG. 17, upon starting (step 174) of the monitor replenishment routine 173, a repeat loop 175 is initiated under which it is determined (1) whether the lever arm 60 of the integral activator 58 continues to be deflected and, if so, (2) whether sufficient replenishment time has elapsed to return to the monitor normal dispense routine 157 of FIG. 15. In particular, if the monitor replenishment routine 173 determines that the lever arm 60 of the integral activator 58 remains deflected (step 176), the monitor replenishment routine 173 then determined (step 177) whether the elapsed time since the time at which the most previous activation of the agitator assembly 91 began, i.e. timeNow—timeLastAgitate, has exceeded a REFILL_TIME constant. In accordance with this exemplary implementation of the present invention, the REFILL_TIME constant is a configured expected "worst case" minimum agitation time required to replenish ice in and about the auger trough 82 and auger conveyor 124 to a "filled" level such that it may safely be expected that dispensing of ice may continue for a time period of at least the REFILL_DELAY time before it may again be expected that ice in and about the auger trough 82 and auger conveyor 124 will again likely be imminently depleted due to the ongoing dispensing of ice. If the elapsed time since the time at which the most previous activation of the agitator assembly 91 began has not exceeded the REFILL_TIME constant, the repeat loop 175 continues.

If, on the other hand, the elapsed time since the time at which the most previous activation of the agitator assembly 91 began has exceeded the REFILL_TIME constant, the repeat loop 175 escapes and the monitor replenishment routine 173 immediately calls (step 178) the end agitation function 179 of FIG. 18. As shown in FIG. 18, upon starting (step 180) of the end agitation function 179, the end agitation function 179 simply sends (step 181) a control signal to deactivate the electric motor 118 of the agitator assembly 91, the details of implementation of such control signal being well within the ordinary skill in the art. Upon sending (step 181) the control signal, the end agitation function 179 will then return (step 182) to the program flow location immediately following that from which the function 179 was called, which in the present case is back the monitor replenishment routine 173 of FIG. 17 to then call (step 183) the monitor normal dispense routine 157 of FIG. 15, which routine 157, it is noted, will start anew at its beginning step (step 158).

If, however, upon checking the status of the lever arm 60 of the integral activator 58 (step 176) in the course of its ongoing repeat loop 175, the monitor replenishment routine 173 of FIG. 17 determines that the lever arm 60 of the integral activator 58 no longer remains deflected, the repeat loop 175 escapes and the monitor replenishment routine 173 immediately calls (step 184) the end dispensing function 185 of FIG. 19, as has been previously described. Upon return from execution of the end dispensing function 185, the monitor replenishment routine 173 then calls (step 191) the monitor complete replenishment routine 192 of FIG. 20. Under the monitor complete replenishment routine 173, the agitator assembly 91 is allowed to continue to operate until sufficient time has elapsed since the time at which the most previous activation of the agitator assembly 91 began to ensure that the area in and about the auger trough 82 and auger conveyor 124 has been replenished with ice. Additionally, during completion of the replenishment operation, the monitor complete replenishment routine 173 monitors the status of the lever arm 60 of the integral activator 58 in order to respond to any additional user request for dispensing of ice.

Figure 20:
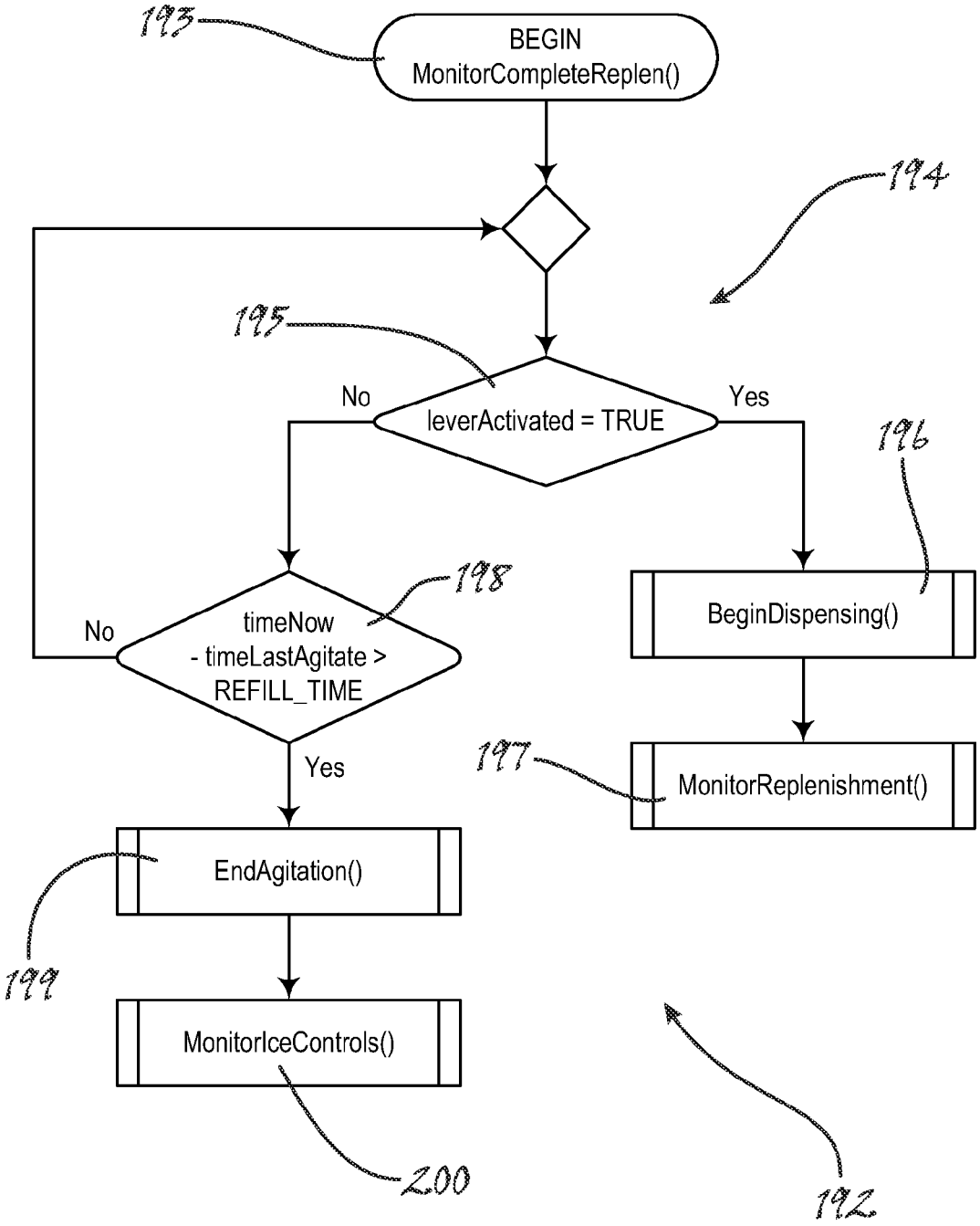
FIG. 20 shows, in a flowchart, an exemplary monitor complete replenishment routine as may be implemented under the main ice control program of FIG. 11 for operation of the integrated ice and beverage dispenser of FIG. 1.

As shown in FIG. 20, upon starting (step 193) of the monitor complete replenishment routine 192, a repeat loop 194 is initiated to determine (1) whether the lever arm 60 of the integral activator 58 has been deflected (step 195), indicating that a user again desires that ice be dispensed, or, if not, (2) whether sufficient replenishment time has elapsed to return to the monitor ice controls routine 142 of FIG. 13 (step 198). If during the conduct of the repeat loop 194 the monitor complete replenishment routine 192 first determines that the lever arm 60 of the integral activator 58 has been deflected (step 195), the repeat loop 194 escapes and the monitor complete replenishment routine 192 immediately calls (step 196) the begin dispensing function 152 of FIG. 14, as has been previously described in detail, and, upon return from the begin dispensing function 152, the monitor complete replenishment routine 192 then calls (step 197) the monitor replenishment routine 173 of FIG. 17, as has also been previously described in detail and which routine 173, it is noted, will start anew at its beginning step (step 174).

If, on the other hand, during the conduct of the repeat loop 194 the monitor complete replenishment routine 192 of FIG. 20 first determines that the elapsed time since the time at which the most previous activation of the agitator assembly 91 began, i.e. timeNow—timeLastAgitate, has exceeded the REFILL_TIME constant (step 198), indicating that the area in and about the auger trough 82 and auger conveyor 124 has been sufficiently replenished with ice, the repeat loop 194 escapes and the monitor complete replenishment routine 192 immediately calls (step 199) the end agitation function 179 of FIG. 18, as has been previously described in detail, and, upon return from the end agitation function 179, the monitor complete replenishment routine 192 then calls (step 200) the monitor ice controls routine 142 of FIG. 13, as has also been previously described in detail and which routine 142, it is noted, will start anew at its beginning step (step 148).

Figure 21:
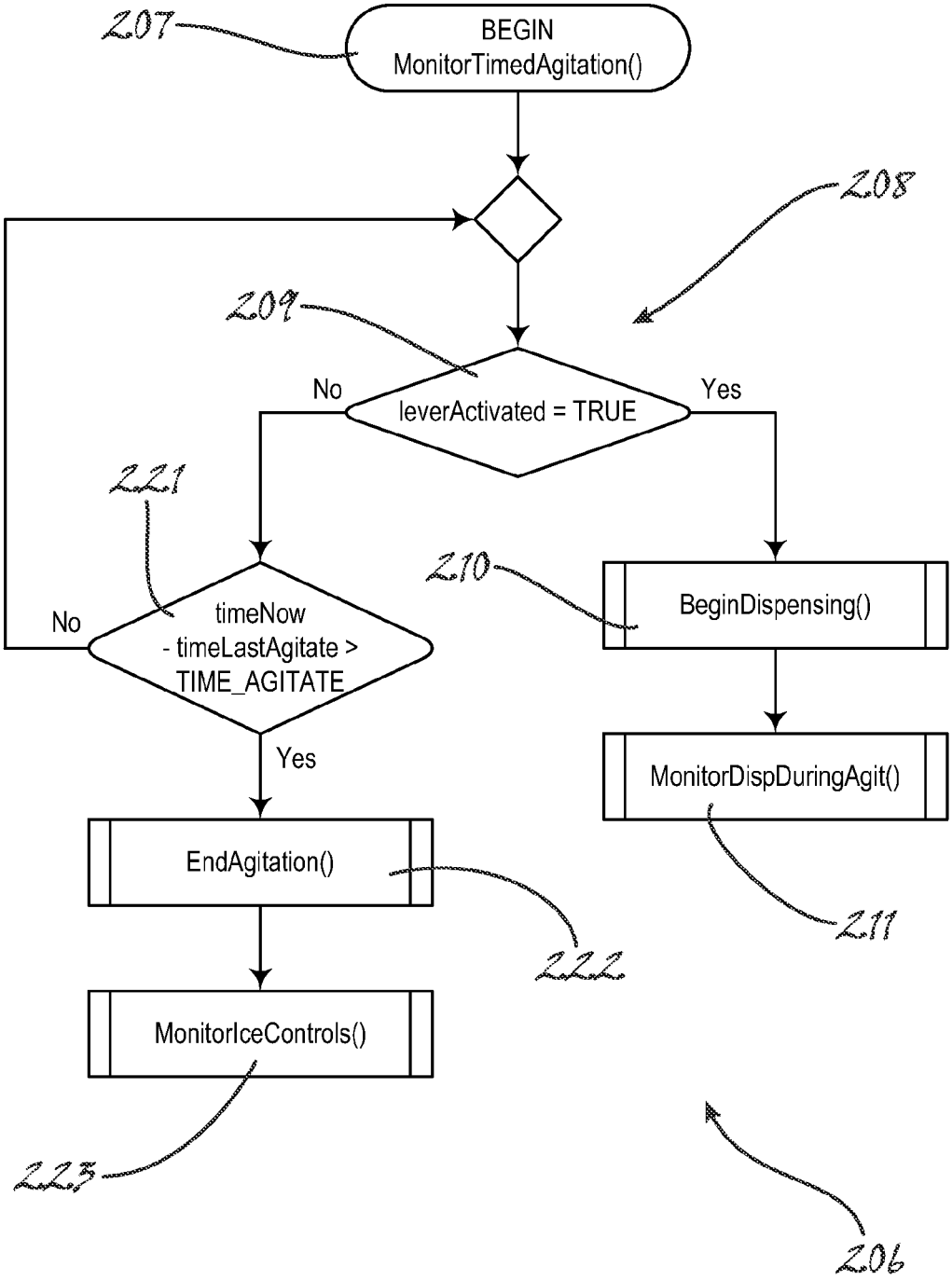
FIG. 21 shows, in a flowchart, an exemplary monitor timed agitation routine as may be implemented under the main ice control program of FIG. 11 in connection with implementation of the further methods of the present invention enabled in implementation of the agitation monitor routine of FIG. 12.

Returning finally then to the remainder of the description of the monitor ice controls routine 142 of FIG. 13, if thereunder it is determined that agitation of the ice within the ice bin 69 is required as a matter of the passage of time (step 203), the monitor ice controls routine 142 will escape its repeat loop 149 and operate to first call (step 204) the begin agitation function 165 of FIG. 16, thereby causing, as has previously been described in detail, activation of the agitator assembly 91, and, upon return from the begin agitation function 165, the monitor ice controls routine 142 will then operate to call (step 205) the monitor timed agitation routine 206 of FIG. 21, under which, the routine 206 will operate to monitor whether, during passage of the established time for agitation, the lever arm 60 of the integral activator 58 has been deflected (step 209), indicating that a user desires that ice be dispensed and, if so, ensures that the user's desire is immediately acted upon.

Referring then to FIG. 21, upon starting (step 207) of the monitor timed agitation routine 206, a repeat loop 208 is initiated to determine (1) whether the lever arm 60 of the integral activator 58 has been deflected (step 209), indicating that a user desires that ice be dispensed, or (2) whether the configured time TIME_AGITATE (determined as a matter of design implementation as an estimate of the nominal agitation time required to prevent and/or alleviate any issues of ice blocking, clumping or the like and/or to ensure that ice flow from the upper compartment 79 of the ice bin 69 to the lower compartment 80 of the ice bin 69 is sufficiently facilitated)

has elapsed since the time at which the most previous activation of the agitator assembly 91 began (step 221). In the present implementation, Applicant has found that approximately seven seconds is a suitable time for the TIME_AGITATE constant.

If during the conduct of the repeat loop 208 the monitor timed agitation routine 206 first determines that the elapsed time since the time at which the most previous activation of the agitator assembly 91 began exceeds the configured time TIME_AGITATE (step 221), the repeat loop 208 escapes and the monitor timed agitation routine 206 immediately calls (step 222) the end agitation function 179 of FIG. 18, as has been previously described in detail, and, upon return from the end agitation function 179, the monitor timed agitation routine 206 then calls (step 223) the monitor ice controls routine 142 of FIG. 13, as has also been previously described in detail and which routine 142, it is noted, will start anew at its beginning step (step 148). If, on the other hand, during the conduct of the repeat loop 208 the monitor timed agitation routine 206 first determines that the lever arm 60 of the integral activator 58 has been deflected (step 209), indicating that during the conduct of the agitation cycle in process a user also desires that ice be dispensed, the repeat loop 208 escapes and the monitor timed agitation routine 206 immediately calls (step 210) the begin dispensing function 152 of FIG. 14, as has been previously described in detail, and, upon return from the begin dispensing function 152, the monitor timed agitation routine 206 then calls (step 211) the monitor dispense during agitation routine 212 of FIG. 22, during which the user's request for ice is immediately addressed while still monitoring the ongoing timed agitation to ensure, in generally the manner as previously discussed, sufficient agitation.

Figure 22:
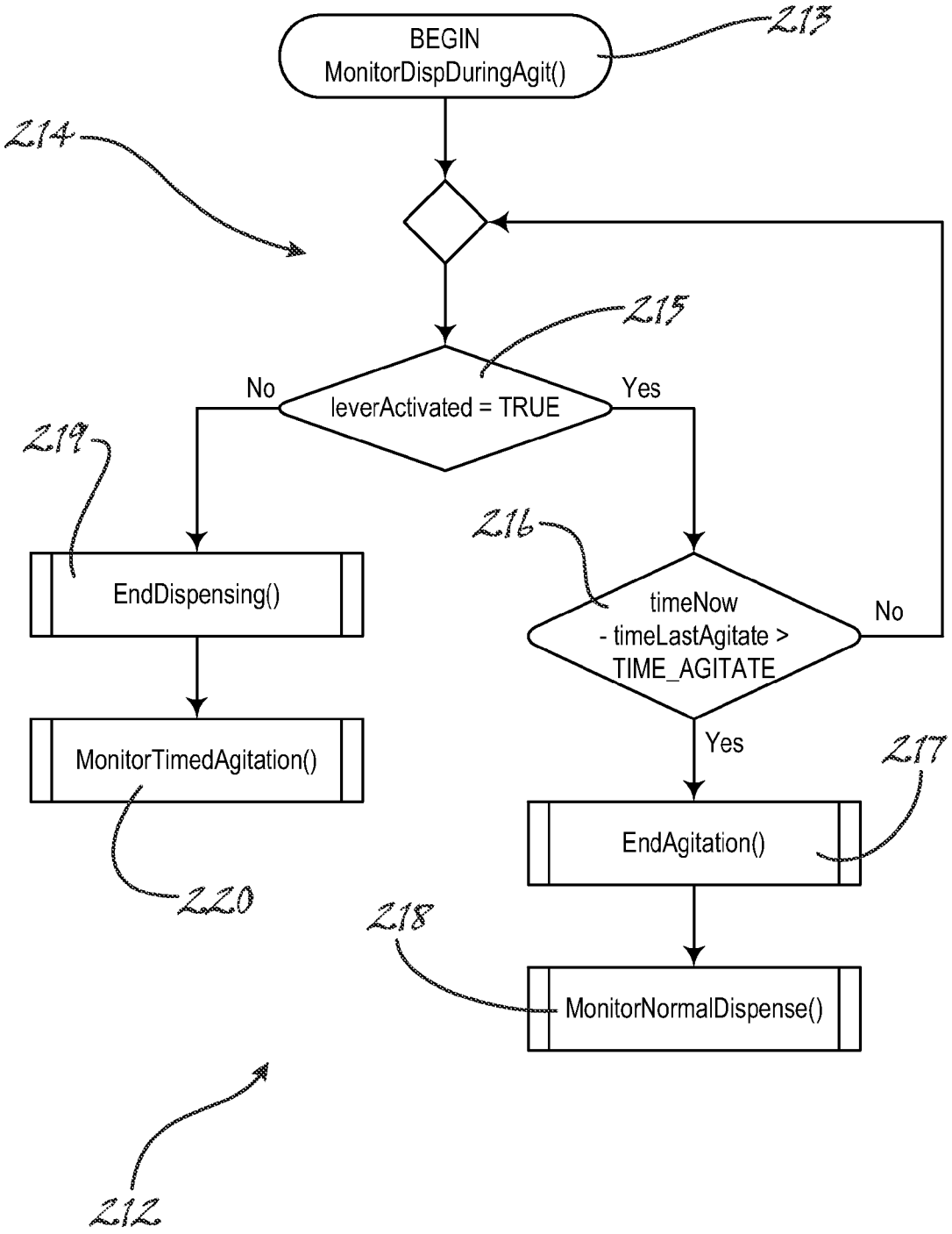
FIG. 22 shows, in a flowchart, an exemplary monitor dispense during agitation routine as may be implemented under the main ice control program of FIG. 11 in connection with implementation of the further methods of the present invention enabled in implementation of the agitation monitor routine of FIG. 12.

As shown in FIG. 22, upon starting (step 213) of the monitor dispense during agitation routine 212, a repeat loop 214 is initiated to determine (1) whether the lever arm 60 of the integral activator 58 remains deflected (step 215) and (2) whether the elapsed time since the time at which the most previous activation of the agitator assembly 91 began exceeds the configured time TIME_AGITATE (step 216). If it is first determined that the lever arm 60 of the integral activator 58 is no longer deflected (step 215), the repeat loop 214 escapes and the monitor dispense during agitation routine 212 immediately calls (step 219) the end dispensing function 185 of FIG. 19, as has been previously described in detail, and, upon return from the end dispensing function 185, the monitor dispense during agitation routine 212 then calls (step 220) the monitor timed agitation routine 206 of FIG. 21, as has been previously described in detail and which routine 206, it is noted, will start anew at its beginning step (step 207) to continue monitoring the ongoing timed agitation. If, on the other hand, it is first determined that the elapsed time since the time at which the most previous activation of the agitator assembly 91 began exceeds the configured time TIME_AGITATE (step 216), indicating that agitation is no longer required merely as a matter of the passage of time, the repeat loop 214 escapes and the monitor dispense during agitation routine 212 immediately calls (step 217) the end agitation function 179 of FIG. 18, as has been previously described in detail, and, upon return from the end agitation function 179, the monitor dispense during agitation routine 212 then calls (step 218) the monitor normal dispense routine 157 of FIG. 15, as has been previously described in detail and which routine 218, it is noted, will start anew at its beginning step (step 158) to handle the ongoing dispensing of ice in the manner of the ordinary case where dispensing is called for without there being timed agitation in process.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and the claims drawn thereto. Additionally, because the methods of the present invention are largely automated once implemented, it is noted that except as otherwise heretofore set forth the manner of use of the integrated ice and beverage dispenser 30 or, alternatively, an ice only dispenser is as conventionally well in the art. In any case, because the scope of the present invention is much broader than any particular embodiment, the foregoing detailed description should not be construed as a limitation of the scope of the present invention, which is limited only by the claims appended hereto.

What is claimed is:

1. A method for handling ice in connection with an ice dispenser, said method for handling ice, comprising:

providing an ice dispenser, said ice dispenser comprising:

an ice bin for storing ice, said ice bin having an ice chute leading therefrom, an agitator assembly, said agitator assembly having an agitator bar assembly located within said ice bin and an agitator motor coupled to and adapted to rotate said agitator bar assembly, and an auger assembly, said auger assembly having an auger located within said ice bin and terminating in said ice chute and an auger motor coupled to and adapted to rotate said auger;

providing a controller that selectively controls activation of said agitator motor;

supplying said ice bin with a quantity of ice;

dispensing a portion of said quantity of ice from said ice bin by activating said auger motor to rotate said auger and thereby push said portion of said quantity of ice through said ice chute; and wherein said controller:

determines duration of operation of said auger motor accumulated following activation of said auger motor, determines whether said accumulated duration of operation of said auger motor exceeds an auger threshold value, and activates said agitator motor upon determination by said controller that said accumulated duration of operation of said auger motor has exceeded said auger threshold value.

2. The method for handling ice as recited in claim 1, wherein:

said controller:

determines time elapsed following activation of said agitator motor;

determines whether said time elapsed following activation of said agitator motor exceeds an agitator threshold value; and activates said agitator motor upon determination by said controller that said time elapsed following activation of said agitator motor has exceeded said agitator threshold value.

3. The method for handling ice as recited in claim 2, wherein said agitator threshold value is user configurable.

4. The method for handling ice as recited in claim 1, wherein said auger threshold value is user configurable.

5. The method for handling ice as recited in claim 2, wherein said controller activates said agitator motor upon first occurrence of a timing event selected from the group consisting of:

determination by said controller that said time elapsed following activation of said agitator motor has exceeded said agitator threshold value; and determination by said controller that said accumulated duration of operation of said auger motor has exceeded said auger threshold value.

6. The method for handling ice as recited in claim 5, wherein said agitator threshold value is user configurable.

7. The method for handling ice as recited in claim 5, wherein said auger threshold value is user configurable.

8. The method for handling ice as recited in claim 7, wherein said agitator threshold value is user configurable.

9. The method for handling ice as recited in claim 5, wherein:

said ice dispenser further comprises an ice bin insert; and wherein:

a first portion of said ice bin insert is adapted to substantially conform about an underside portion of said agitator bar assembly; and a second portion of said ice bin insert is adapted to substantially conform about an underside portion of said auger.

10. The method for handling ice as recited in claim 9, wherein:

said ice bin insert substantially divides said ice bin into an upper ice compartment and a lower ice compartment; and said first portion of said ice bin insert comprises an aperture adapted to enable passage from said upper ice compartment to said lower ice compartment of a quantity of ice.

11. The method for handling ice as recited in claim 10, wherein said first portion of said ice bin insert comprises a plurality of said apertures.

* * * * *